US011111094B2

(12) United States Patent
Matsuda

(10) Patent No.: US 11,111,094 B2
(45) Date of Patent: Sep. 7, 2021

(54) SHEET FEEDING DEVICE AND IMAGE FORMING SYSTEM INCORPORATING THE SHEET FEEDING DEVICE

(71) Applicant: Ricoh Company, Ltd., Tokyo (JP)

(72) Inventor: Takahiro Matsuda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 97 days.

(21) Appl. No.: 16/456,329

(22) Filed: Jun. 28, 2019

(65) Prior Publication Data

US 2020/0002114 A1 Jan. 2, 2020

(30) Foreign Application Priority Data

Jun. 29, 2018 (JP) ..... JP2018-124598
Jun. 21, 2019 (JP) ..... JP2019-115183

(51) Int. Cl.

| | |
|---|---|
| ***B65H 7/18*** | (2006.01) |
| ***B65H 7/06*** | (2006.01) |
| ***B65H 7/20*** | (2006.01) |
| ***G03G 15/00*** | (2006.01) |
| ***B65H 1/14*** | (2006.01) |

(52) U.S. Cl.

CPC ..... *B65H 7/18* (2013.01); *B65H 1/14* (2013.01); *B65H 7/06* (2013.01); *B65H 7/20* (2013.01); *G03G 15/6511* (2013.01); *G03G 15/70* (2013.01); *B65H 2513/50* (2013.01)

(58) Field of Classification Search

CPC ..... B65H 1/14; B65H 3/047; B65H 3/128; B65H 3/48; B65H 7/06; B65H 7/12; B65H 7/18; B65H 7/20; B65H 2511/515; B65H 2513/50; G03G 15/70

See application file for complete search history.

(56) References Cited

U.S. PATENT DOCUMENTS

| | | | | |
|---|---|---|---|---|
| 7,806,400 | B2 * | 10/2010 | Fukusaka | B65H 3/48 271/104 |
| 2007/0126171 | A1 * | 6/2007 | Takeuchi | B65H 3/5261 271/121 |
| 2017/0210582 | A1 * | 7/2017 | Okano | B65H 5/062 |
| 2018/0099827 | A1 * | 4/2018 | Tsuboi | B41J 11/0095 |
| 2019/0185280 | A1 * | 6/2019 | Nishikawa | B65H 3/08 |

FOREIGN PATENT DOCUMENTS

| | | |
|---|---|---|
| JP | 8-169632 | 7/1996 |
| JP | 2002-167396 | 6/2003 |

* cited by examiner

*Primary Examiner* — Prasad V Gokhale
(74) *Attorney, Agent, or Firm* — Xsensus LLP

(57) ABSTRACT

A sheet feeding device includes a sheet loader, a sheet feeder, a misfeeding detector, a memory, and circuitry. The sheet loader is configured to load a sheet of a sheet bundle. The sheet feeder is configured to feed a sheet from the sheet bundle loaded on the sheet loader. The misfeeding detector is configured to detect a misfeeding of the sheet. The memory is configured to store sheet feed information on sheet feeding. The circuitry is configured to change a sheet feed setting based on the sheet feed information stored in the memory and perform a retry sheet feeding at a detection of the misfeeding by the misfeeding detector.

20 Claims, 12 Drawing Sheets

SHEET FEEDING DEVICE AND IMAGE FORMING SYSTEM INCORPORATING THE SHEET FEEDING DEVICE

CROSS-REFERENCE TO RELATED APPLICATIONS

This patent application is based on and claims priority pursuant to 35 U.S.C. § 119(a) to Japanese Patent Application Nos. 2018-124598, filed on Jun. 29, 2018, and 2019-115183, filed on Jun. 21, 2019, in the Japan Patent Office, the entire disclosure of each of which is hereby incorporated by reference herein.

BACKGROUND

Technical Field

This disclosure relates to a sheet feeding device and an image forming system incorporating the sheet feeding device.

Related Art

Various types of known sheet feeding devices include a sheet feeding unit that feeds a sheet loaded on a sheet loader, a failed conveyance detecting unit that detects a failed sheet feeding (in other words, a misfeeding) of the sheet, and a controller that performs a retry sheet feeding in a case in which the failed conveyance detecting unit detects the misfeeding.

A known sheet feeding device performs a retry conveyance at a lower sheet feeding speed so that the sheet feeding reliability is enhanced to with respect to the misfeeding caused by slippage between a sheet feeding unit and a sheet. As a result, occurrence of the misfeeding in the retry sheet feeding is restrained.

SUMMARY

At least one aspect of this disclosure provides a sheet feeding device including a sheet loader, a sheet feeder, a misfeeding detector, a memory, and circuitry. The sheet loader is configured to load a sheet of a sheet bundle. The sheet feeder is configured to feed a sheet from the sheet bundle loaded on the sheet loader. The misfeeding detector is configured to detect a misfeeding of the sheet. The memory is configured to store sheet feed information on sheet feeding. The circuitry is configured to change a sheet feed setting based on the sheet feed information stored in the memory and perform a retry sheet feeding in response to a detection of the misfeeding by the misfeeding detector.

Further, at least one aspect of this disclosure provides an image forming system including an image forming apparatus configured to perform image formation, and the above-described sheet feeding device configured to feed a sheet toward the image forming apparatus.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
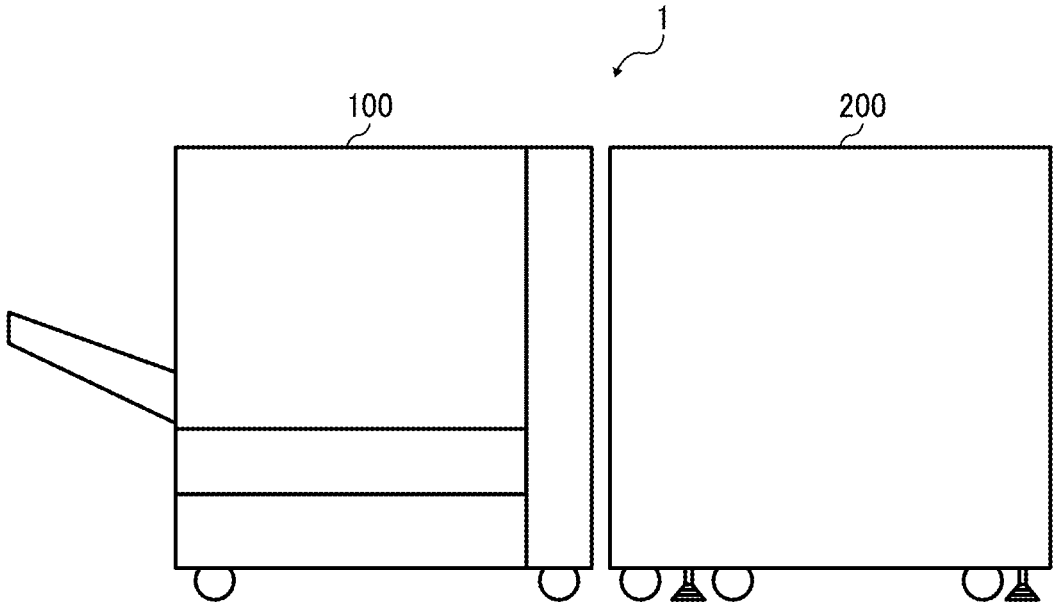
FIG. 1 is a diagram illustrating a schematic configuration of an image forming system according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any drying device, and is implemented in the most effective manner in an inkjet image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Descriptions are given of a sheet feeding device according to an embodiment of this disclosure and an image forming system including the sheet feeding device.

It is to be noted that elements (for example, mechanical parts and components) having the same functions and shapes are denoted by the same reference numerals throughout the specification and redundant descriptions are omitted.

FIG. 1 is a diagram illustrating a schematic configuration of an image forming system 1 according to an embodiment of this disclosure.

It is to be noted in the following examples that: the term "printer" indicates an apparatus in which an image is printed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., an OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet feeding direction" indicates a direction in which a recording medium travels from an upstream side of a sheet conveyance passage to a downstream side thereof; the term "width direction" indicates a direction basically perpendicular to the sheet conveying direction.

As illustrated in FIG. 1, the image forming system 1 includes an image forming apparatus 100 to form an image on a sheet and a sheet feeding device 200 to feed a sheet to the image forming apparatus 100. The sheet feeding device 200 is provided next to a side face of an apparatus body of the image forming apparatus 100.

It is to be noted that the present embodiment describes an electrophotographic image forming apparatus to which the sheet feeding device according to the present embodiment of this disclosure is applied. However, the image forming method of the electrophotographic image forming apparatus may be other types such as an inkjet method.

Figure 2:
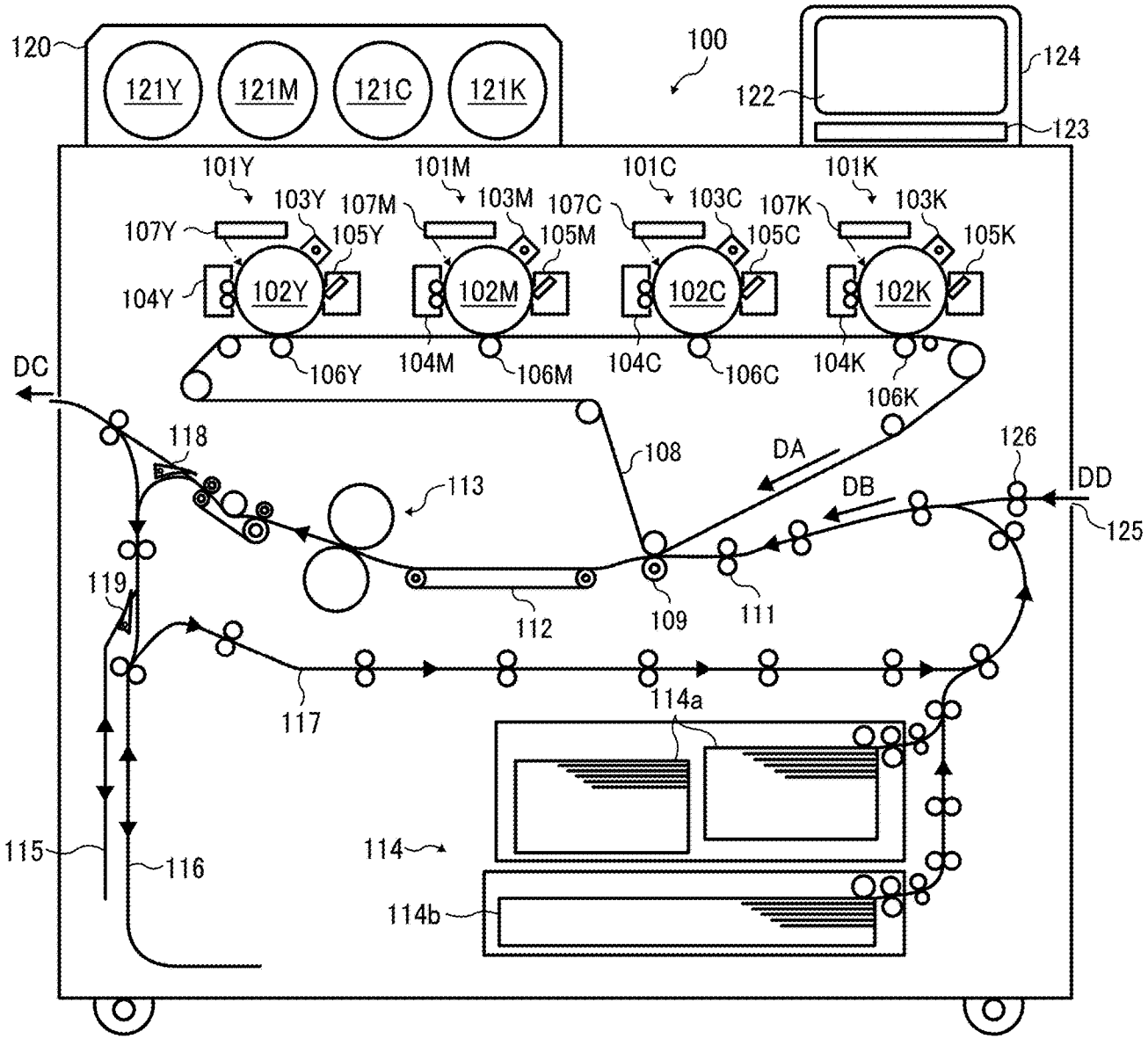
FIG. 2 is a diagram illustrating a schematic configuration of an image forming apparatus according to an embodiment of this disclosure.

FIG. 2 is a diagram illustrating a schematic configuration of the image forming apparatus 100 according to an embodiment of this disclosure.

The image forming apparatus 100 has printing and copying functions for forming a full color image with four color toners such as yellow (Y), magenta (M), cyan (C), and black (K).

As illustrated in FIG. 2, the image forming apparatus 100 includes four image forming units 101Y, 101M, 101C, and 101K. The image forming units 101Y, 101M, 101C, and 101K, each of which forms a corresponding single color image, are aligned at an upper part of the apparatus body of the image forming apparatus 100. The image forming units 101Y, 101M, 101C, and 101K have a substantially identical configuration and functions to each other. Therefore, the following details of the image forming units 101Y, 101M, 101C, and 101K are described as a single image forming unit that corresponds to each of the image forming units 101Y, 101M, 101C, and 101K, without the suffixes Y, M, C, and K indicating respective colors. The image forming unit 101 (i.e., the image forming units 101Y, 101M, 101C, and 101K) includes a photoconductor drum 102 (i.e., photoconductor drums 102Y, 102M, 102C, and 102K), a charger 103 (i.e., chargers 103Y, 103M, 103C, and 103K), a developing device 104 (i.e., developing devices 104Y, 104M, 104C, and 104K) and a cleaning device 105 (i.e., cleaning devices 105Y, 105M, 105C, and 105K). The charger 103, the developing device 104, and the cleaning device 105 are disposed around the photoconductor drum 102. Further, an optical writing device 107 is disposed above the photoconductor drum 102.

An intermediate transfer belt 108 is disposed below the image forming units 101Y, 101M, 101C, and 101K. The intermediate transfer belt 108 is wound around multiple support rollers. As one of the multiple support rollers is driven by a drive unit, the intermediate transfer belt 108 is rotated in a direction indicated by arrow DA in FIG. 2. A transfer roller 106 (i.e., transfer rollers 106Y, 106M, 106C, and 106K) that functions as a primary transfer body is disposed facing the photoconductor drum 102 of the image forming unit 101 with the intermediate transfer belt 108 interposed between the photoconductor drum 102 and the transfer roller 106. When the transfer roller 106 and the photoconductor drum 102 contact while interposing the intermediate transfer belt 108, a primary transfer portion is formed to primarily transfer the toner image onto the photoconductor drum 102.

In the image forming unit 101, the photoconductor drum 102 is rotated in a counterclockwise direction in FIG. 2. Then, the charger 103 uniformly charges a surface of the photoconductor drum 102 to a predetermined polarity. Then, an optically modulated laser light beam is emitted from the optical writing device 107, so that an electrostatic latent image is formed on the charged surface of the photoconductor drum 102. The electrostatic latent image is developed with toner applied by the developing device 104 into a visible toner image. The visible toner images of respective single colors (yellow, magenta, cyan, and black) formed by the image forming units 101Y, 101M, 101C, and 101K are sequentially transferred in layers onto the surface of the intermediate transfer belt 108.

By contrast, a sheet feeding section 114 is disposed in a lower part of the apparatus body of the image forming apparatus 100. The sheet feeding section 114 includes sheet trays 114*a* and 114*b*. A sheet that functions as a recording medium is fed out from a selected one of the sheet feeding section 114 and the sheet feeding device 200 that is attached to the image forming apparatus 100. The fed sheet is conveyed toward a pair of registration rollers 111 in a direction indicated by arrow DB in FIG. 2.

The sheet contacted and temporarily stopped at the pair of registration rollers 111 is fed out from the pair of registration rollers 111 in synchronization with movement of the toner image formed on the surface of the intermediate transfer belt 108. Then, the sheet is conveyed to a secondary transfer portion where a secondary transfer roller 109 contacts the intermediate transfer belt 108. A voltage having an opposite polarity to a toner charge polarity is applied to the secondary transfer roller 109. By so doing, the composite toner image (the full-color image) formed on the surface of the intermediate transfer belt 108 is transferred onto the sheet. After the toner image has been transferred onto the sheet, the sheet is conveyed by a sheet conveying belt 112 to a fixing device 113. In the fixing device 113, the toner image is fixed to the sheet by application of heat and pressure. After the toner image is fixed to the sheet, the sheet is ejected out of the apparatus body of the image forming apparatus 100 as indicated by arrow DC in FIG. 2 onto a sheet ejection tray.

It is to be noted that, when the sheet is ejected with the back of the sheet facing up in the single-side printing (a face down ejection), the sides (i.e., the front and the back) of the sheet are reversed by ejecting the sheet to the outside of the apparatus body of the image forming apparatus 100, as indicated by arrow DC in FIG. 2, via a sheet reverse portion 115. Further, in the duplex printing, the pair of registration rollers 111 after the toner image has been fixed to one side (i.e., the front side) of the sheet is conveyed via a duplex reverse portion 116 from a reentry passage 117 to the pair of registration rollers 111 again. By so doing, a toner image formed on the surface of the intermediate transfer belt 108 is transferred onto the back of the sheet. After the toner image has been transferred onto the sheet, the toner image is fixed to the sheet in the fixing device 113. Then, similar to the single-side printing, the sheet is ejected out in the direction DC in FIG. 1 directly from the fixing device 113 or via the sheet reverse portion 115 in the direction DC in FIG. 1. Further, the image forming apparatus 100 further includes switching claws 118 and 119, each of which is appropriately disposed to switch the sheet conveying direction.

In a case of a monochrome printing, the image forming apparatus 100 according to the present embodiment uses the image forming unit 101K to form a monochrome toner image and transfers the monochrome toner image onto a sheet (in other words, a transfer paper) via the intermediate transfer belt 108. A sheet having a monochrome toner image thereon is handled along the same process as a sheet having a full color toner image after the toner image is fixed to the sheet.

It is to be noted that the image forming apparatus 100 further includes a toner bottle setting unit 120 on an upper face of the apparatus body of the image forming apparatus 100. The toner bottle setting unit 120 sets respective color toner bottles 121 (i.e., toner bottles 121Y, 121M, 121C, and 121K) that contains toner to be supplied to the developing device 104 of the image forming unit 101.

Further, the image forming apparatus 100 further includes a control unit 124 that includes a display 122 and a control panel 123. In addition, the sheet feeding device 500 is provided on the right side of the apparatus body of the image forming apparatus 100 in FIG. 2. A sheet fed from the sheet feeding device 200 (see FIG. 3) comes in the apparatus body of the image forming apparatus 100 through the sheet entrance DD. At the sheet entrance DD, a bypass tray opening 125 and a pair of bypass rollers 126 are provided. The sheet is received through the bypass tray opening 125 and then is conveyed by the pair of bypass rollers 126.

It is to be noted that, as described above, a sheet in the above-described embodiment of this disclosure is not limited to indicate a paper but also includes any other sheet-like material such as coated paper, label paper, OHP film sheet, film, prepreg (i.e., a sheet-like material fabricated by impregnating carbon fibers with resin), multi-layered sheet (i.e., sheet including multiple different materials made into a single sheet), metallic sheet (i.e., sheet including metallic components), and processed sheet (i.e., a sheet bound with staplers, and an envelope with folded portions).

Figure 3:
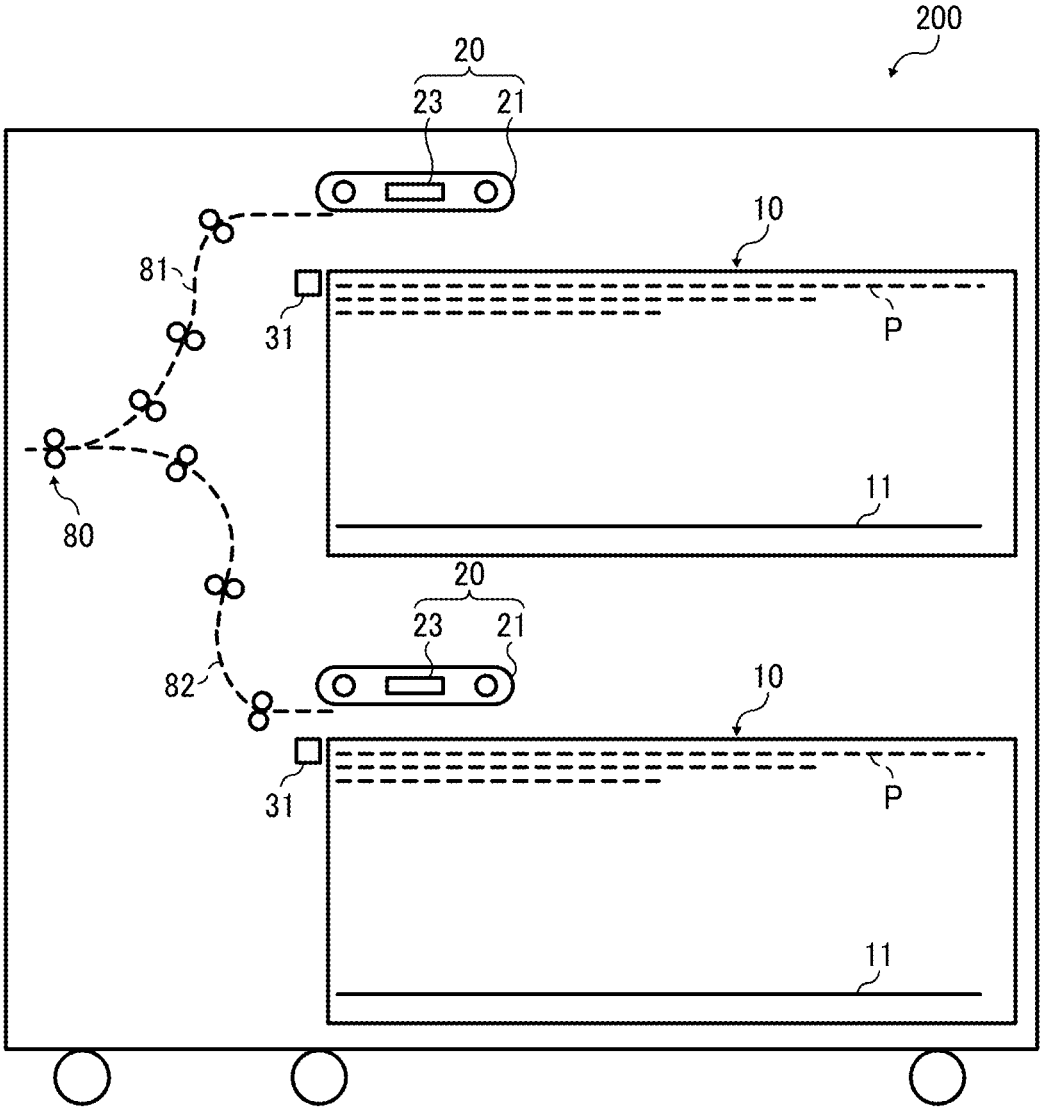
FIG. 3 is a schematic diagram illustrating a sheet feeding device, which is disposed to the side face of an apparatus body of the image forming apparatus, according to Embodiment 1 of this disclosure.

FIG. 3 is a diagram illustrating a schematic configuration of the sheet feeding device 200 according to the present embodiment this disclosure. The sheet feeding device 200 is disposed to the side face of the apparatus body of the image forming apparatus 100.

As illustrated in FIG. 3, the sheet feeding device 200 includes two sheet trays 10 disposed vertically to each other (i.e., a lower sheet tray 10 and an upper sheet tray 10). Each of the sheet trays 10 includes a sheet loading table 11 that functions as a sheet loader on which a sheet bundle P is loaded. In the present embodiment, each of the sheet trays 10 is capable of containing up to about 2500 sheets.

It is to be noted that the term "sheet" includes plain paper, coated paper, label paper, OHP sheet and film, prepreg, multi-layered sheet, metallic sheet, and processed sheet. Prepregs are mainly used as materials for laminates and multilayer printed wiring boards. A sheet feeding unit 20 is disposed above the corresponding sheet tray 10. The sheet feeding unit 20 separates and feeds a sheet loaded on the sheet tray 10. Each sheet feeding unit 20 includes a suction belt 21 as a sheet feeder and an upward suction device 23.

Each sheet loaded on the lower sheet tray 10 passes through a lower conveyance passage 82 to be conveyed by the pair of outlet rollers 80 to the apparatus body of the image forming apparatus 100. Each sheet loaded on the upper sheet tray 10 passes through an upper conveyance passage 81 to be conveyed by the pair of outlet rollers 80 to the apparatus body of the image forming apparatus 100.

Figure 4:
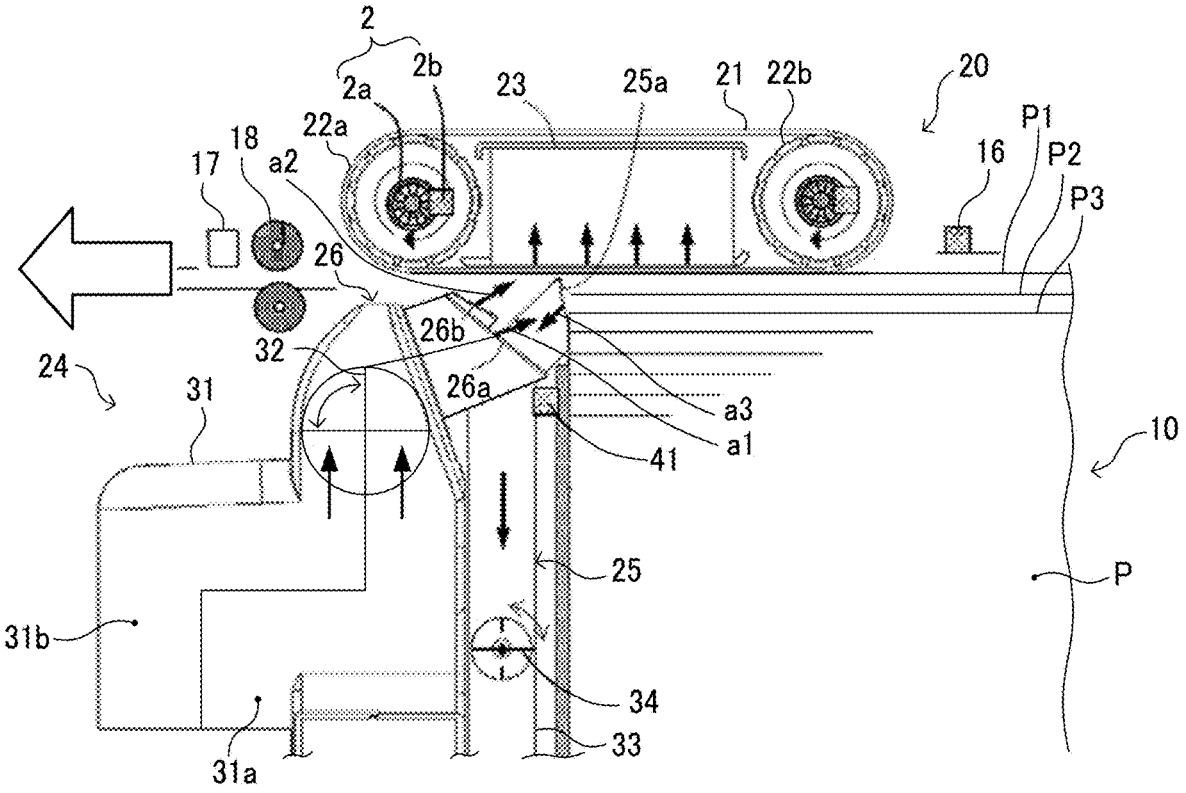
FIG. 4 is a side view illustrating the sheet feeding device according to Embodiment 1.
Figure 5:
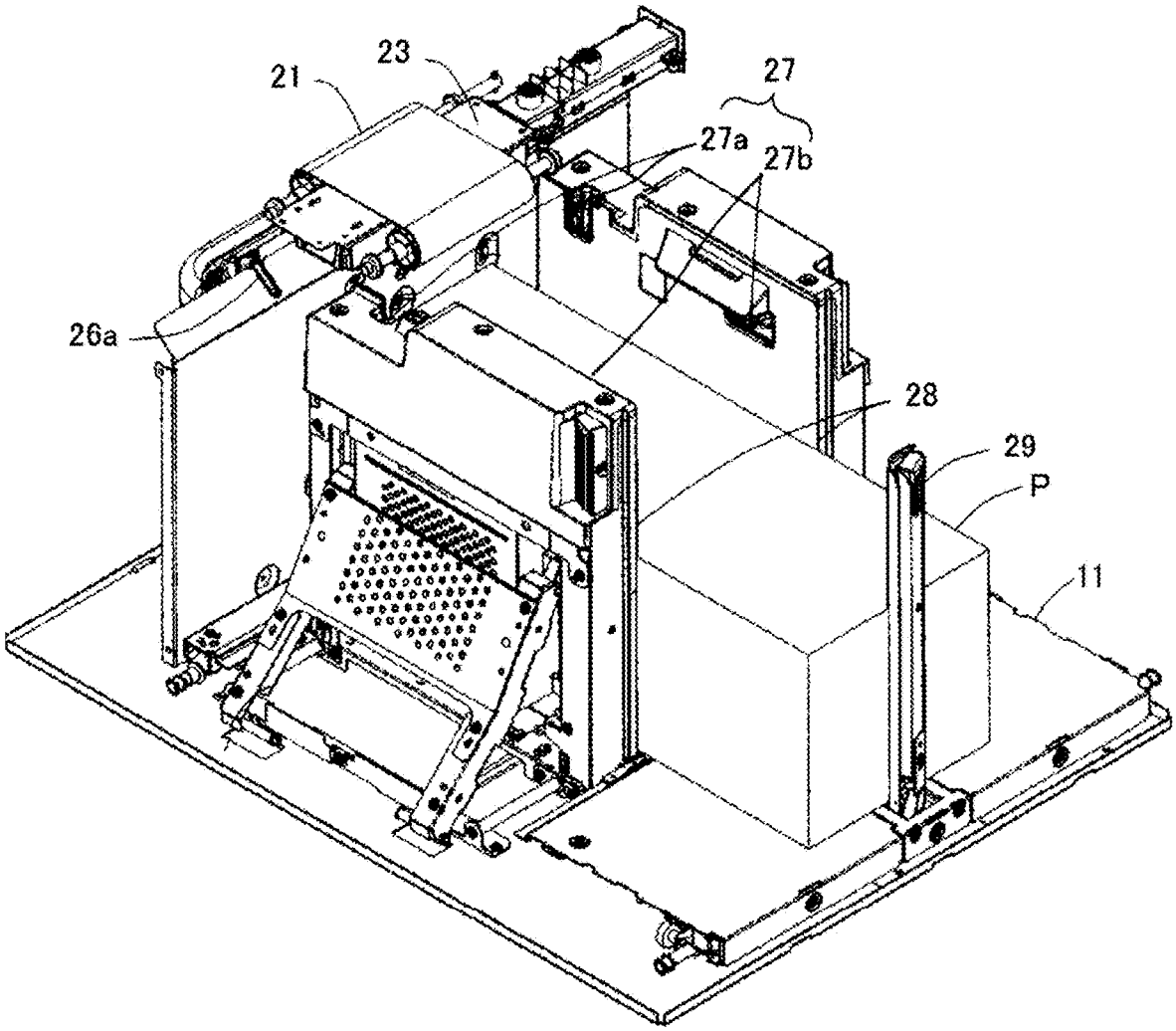
FIG. 5 is a perspective view illustrating the sheet feeding device according to Embodiment 1.

FIG. 4 is a side view illustrating the sheet feeding device 200 according to Embodiment 1. FIG. 5 is a schematic perspective view of the sheet feeding device 200 of FIG. 4.

As illustrated in FIG. 4, the suction belt 21 of the sheet feeding unit 20 that functions as a sheet feeding unit is stretched by two tension rollers 22*a* and 22*b* and includes multiple suction openings over an entire region in a circumferential direction of the suction belt 21. The multiple air drawing openings penetrate through the suction belt 21 from the front face side to the back face side. The upward suction device 23 is disposed within an inner loop of the suction belt 21. The upward suction device 23 is connected to an upward suction fan that functions as an air suction fan to intake air via the air duct that functions as an air flowing passage. As the upward suction device 23 generates a negative pressure in a lower area, the sheet P is attracted to a lower face of the suction belt 21.

Further, each the upper sheet tray 10 and the lower sheet tray 10 includes an air blowing device 24 and a downward suction device 25. The air blowing device 24 functions as an air blowing device to blow air to sheets on an upper portion of the sheet bundle P. The downward suction device 25 functions as an air suction device to draw (intake) air near the upper sheets of the sheet bundle P.

The air blowing device 24 includes a front air blowing device 26 and side air blowing devices 27 (see FIG. 5). As illustrated in FIG. 4, the front air blowing device 26 blows air to the leading end (the downstream end portion in the sheet feeding direction) of the upper portion of the sheet bundle P. The front air blowing device 26 includes a floating nozzle 26*a* and a separation nozzle 26*b*. The floating nozzle 26*a* guides air to blow in the direction to float upper sheets of the sheet bundle P. The separation nozzle 26*b* guides air to blow toward the suction belt 21 to reflect on the suction belt 21, so that the air blown from the separation nozzle 26*b* causes an uppermost sheet (as a first sheet) and other sheets of the sheet bundle P to face downwardly. Furthermore, an air chamber 31 having a floating communication passage 31*a* that communicates with the floating nozzle 26*a* and a separation communication passage 31*b* that communicates with the separation nozzle 26*b* is disposed. Inside the air chamber 31, a floating and separation shutter 32 is provided to instantly shut and open the floating communication passage 31*a* and the separation communication passage 31*b* in the air chamber 31.

In a case in which a subsequent sheet P2 is lifted to contact an uppermost sheet P1 that has been attracted to the suction belt 21, due to overfloating of the second sheet P2 or improper movement of the second sheet P2, it is likely to cause a multi-feed error. In order to address this inconvenience, the floating and separation shutter 32 is closed at a timing when the uppermost sheet P1 is attracted to the suction belt 21 to stop air blowing. By so doing, the second sheet P2 and the subsequent sheets floating in the air (i.e., the second sheet P2 and a third sheet P3 in FIG. 4) is caused to fall to avoid these sheets to contact with the uppermost sheet P1. Accordingly, the multi-feed error is prevented.

The air chamber 31 is provided with a floating fan 62 that functions as an air blower to deliver air to the floating communication passage 31*a* and a separation fan 63 that functions as a separator to deliver air to the separation communication passage 31*b*. Air that is blown from the floating nozzle 26*a* in a direction indicated by arrow a1 in FIG. 4 is referred to as front floating air. Air that is blown from the separation nozzle 26*b* in a direction indicated by arrow a2 in FIG. 4 is referred to as separation air. The front floating air and the separation air are discharged from respective portions facing the leading end of the upper sheets of the sheet bundle P (i.e., the downstream side end in the sheet feeding direction). Consequently, the floating air and the separation air are blown to the leading end of the upper sheets of the sheet bundle P (i.e., the downstream side end in the sheet feeding direction).

Further, as illustrated in FIG. 5, the side air blowing devices 27 are provided on a pair of side fences 28 for positioning the sheet to maintain the attitude of the sheet so that the sheet is not angled or skewed in a width direction of the sheet, corresponding to a direction perpendicular to the feeding direction. The sheet feeding device 200 employs center reference for moving both of the two side fences 28 in the width direction according to the sheet size. Each of the side air blowing devices 27 is mounted on a corresponding one of the side fences 28 so that the side air blowing devices 27 blow air to the end portions in a width direction of the upper part of the sheet bundle P to flip and separate upper sheets of the sheet bundle P.

The side air blowing device 27 includes side floating nozzle front portions 27*a* and side floating nozzle rear portions 27*b*. The side floating nozzle front portions 27*a* are arranged to face front sides of lateral sides of the sheet in the sheet feeding direction and guide air in a direction to separate and float the bundle of sheets P. The side floating nozzle rear portions 27*b* are arranged to face rear sides of the lateral sides of the sheet in the sheet feeding direction. Air blown by a side floating fan 71, which functions as an air blower, from the side floating nozzle front portions 27*a* and the side floating nozzle rear portions 27*b* is referred to as "side floating air". The side floating air is discharged from an air discharging port provided to a portion that faces the upper part of the sheet bundle P of each of the side fences 28 and is blown to the side face of the upper part of the sheet bundle P. The air blown from the floating nozzle 26*a* and the separation nozzle 26*b* of the front air blowing device 26 and the side floating nozzle front portions 27*a* and the side floating nozzle rear portions 27*b* of the side air blowing devices 27 lifts the sheets of the upper part of the sheet bundle P. Further, each sheet trays 10 includes an end fence 29 to align the trailing end of the sheets of the sheet bundle P loaded on the sheet loading table 11.

As indicated by arrow a3 in FIG. 4, the downward suction device 25 intakes air around the leading end of the sheets of the upper part of the sheet bundle P toward the lower portion to generate negative pressure to apply force in a direction to move away from the suction belt 21. The downward suction device 25 includes a downward suction nozzle 25*a* and a downward suction chamber 33. The downward suction nozzle 25*a* suctions air around the leading end of the sheets of the upper part of the sheet bundle P. The downward suction chamber 33 communicates with the downward suction nozzle 25*a*. The downward suction chamber 33 includes a downward suction fan that functions as an air suction unit to intake air. Further, inside the downward suction chamber 33, a downward suction shutter 34 is provided to function as an opening and closing mechanism to instantly switch shutting and opening of air flow inside the downward suction chamber 33.

The downward suction shutter 34 is closed when the floating and separation shutter 32 is open and air is blown out from the floating nozzle 26*a* and the separation nozzle 26*b*. As the floating and separation shutter 32 is closed to stop air blow from the floating nozzle 26*a* and the separation nozzle 26*b*, the downward suction shutter 34 gradually opens, so that air around the leading end of the upper part of the sheet bundle P is drawn via the downward suction nozzle

25*a* to generate negative pressure. Such negative pressure is generated around the leading end of the upper part of the sheet bundle P, so that the speed of fall of the subsequent sheet P2 is accelerated to prevent a multi-feed error.

Further, the gap between the upper end of the downward suction nozzle 25*a* and the suction belt 21 is set to be greater than or equal to the thickness of one sheet and smaller than and equal to the thickness of two sheets. By so doing, even in a case in which the subsequent sheet P2 is attracted to the suction belt 21 and is fed together with the uppermost sheet P1, the upper end of the downward suction nozzle 25*a* stops the leading end of the subsequent sheet P2. Accordingly, the multi-feed error is prevented.

The sheet feeding device 200 includes a lifting sensor 41 to detect the height of an upper surface of the uppermost sheet of the sheet bundle P to use the detection result for determining the position of elevation and the amount of elevation of the sheet loading table 11 when feeding sheets. In the sheet feeding device 200, the distance, which decreases as each sheet of the sheet bundle in the sheet tray is fed, between the upper surface of the uppermost sheet of the sheet bundle in the sheet tray and the lower face of the attraction belt falls within a certain range. Therefore, the sheet feeding device 200 detects the height of the upper surface of the uppermost sheet with the lifting sensor 41, and controls, based on a detection signal of the lifting sensor 41, a lift motor as a drive source of a lifting drive unit to vertically move the sheet loading table 11 of the sheet tray 10. Such a configuration can control the height of the sheet loading table 11, so that the distance between the upper surface of the uppermost sheet of the sheet bungle P placed on the sheet loading table 11 and the bottom surface of the suction belt 21 falls within a certain range.

In addition, a pair of gripping rollers 18 is disposed downstream from the suction belt 21 in the sheet feeding direction. The pair of gripping rollers 18 is a pair of downstream sheet conveying members to convey the sheet P that has been fed by the suction belt 21 and has reached between two rollers of the pair of gripping rollers 18 toward a further downstream side in the sheet feeding direction. A sheet feed sensor 17 is disposed downstream from the pair of gripping rollers 18 in the sheet feeding direction. The sheet feed sensor 17 functions as a sheet sensor to detect a sheet. The sheet feed sensor 17 switches from OFF to ON at arrival of the leading end of a sheet, and changes from ON to OFF when the trailing end of the sheet passes the sheet feed sensor 17. In a case in which the leading end of a sheet is not detected by sheet feed sensor 17 during a period from the start of sheet feeding to the set arrival time, it is determined that no sheet is not fed.

Moreover, a rotation amount detecting device 2 is disposed to detect the number of rotations of the tension roller 22*a*. The rotation amount detecting device 2 that functions as a drive state detector includes an encoder plate 2*a* and an optical sensor 2*b*, both of which are mounted on the rotary shaft of the tension roller 22*a*. By detecting the number of rotations of the tension roller 22*a*, the conveying speed and acceleration of the attraction belt are detected. Further, in the present embodiment, the rotation amount detecting device 2 is provided to each of the floating fan 62, the separation fan 63, the side floating fan 71, and the upper air drawing fan to detect the number (amount) of rotations of each fan. Further, the rotation amount detecting device 2 is also provided to a lifting drive unit that vertically moves (that is, lifts and lowers) the sheet loading table 11, so that the rotation amount detecting device 2 detects the number of rotations of a drive transmitting member such as a gear of the lifting drive unit.

Further, a floating detection sensor 16 is disposed upstream from the sheet feeding unit 20 in the sheet feeding direction to detect floating of a sheet. Further, a paper end sensor 70 is disposed to detect presence or absence of the sheet loaded on the sheet loading table 11. In a case in which the paper end sensor 70 has detected absence of a sheet, a message requesting a user to supply sheets onto the sheet loading table 11 is displayed on a display unit of the image forming apparatus 100.

Figure 6:
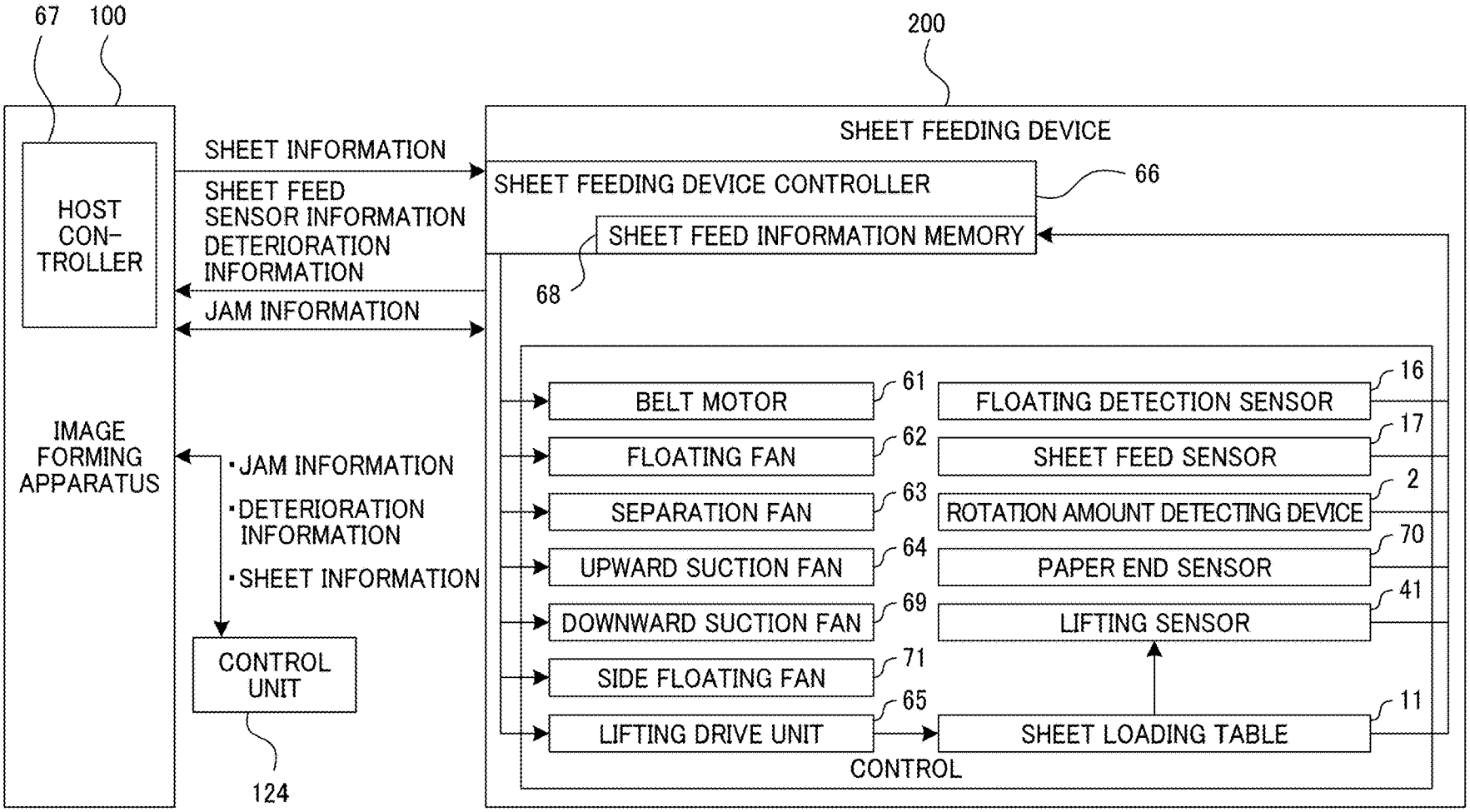
FIG. 6 is a block diagram illustrating the main configuration of the image forming apparatus and the sheet feeding device.

FIG. 6 is a block diagram illustrating the main configuration of the image forming apparatus 100 and the sheet feeding device 200.

The image forming apparatus 100 includes a host controller 67 and the sheet feeding device 200 includes a sheet feeding device controller 66 that functions as a controller of the sheet feeding device 200. To start a sheet feeding operation in the sheet feeding device 200, a user sets (inputs) sheet information including the size of the sheet loaded on the sheet loading table 11 and user setting information via the control unit 124, and the sheet information and the user setting information are sent by the host controller 67 of the image forming apparatus 100 to the sheet feeding device controller 66 of the sheet feeding device 200. The sheet feeding device controller 66 issues instructions based on the sheet information and the user setting information to control a belt motor 61 that drives the suction belt 21, a floating fan 62, a separation fan 63, an upward suction fan 64, a downward suction fan 69, and a lifting drive unit 65 that functions as a loader elevator to elevate (lift and lower) the sheet loading table 11.

The lifting drive unit 65 starts lifting of the sheet loading table 11 in response to an operation start instruction from the sheet feeding device controller 66. Upon detection of the uppermost sheet of the sheet bundle on the sheet loading table 11, the lifting sensor 41 sends a detection signal to the sheet feeding device controller 66. After having received the detection signal from the lifting sensor 41, the sheet feeding device controller 66 sends instruction to the lifting drive unit 65 to stop driving at a timing at which the sheet loading table 11 reaches a set height. Then, the lifting drive unit 65 stops lifting the sheet loading table 11. Accordingly, the distance of the upper surface of the uppermost sheet of the sheet bundle that is loaded on the sheet loading table and the bottom surface of the suction belt 21 becomes constant.

Next, the sheet feeding device controller 66 causes each fan and the belt motor 61 to drive to start the sheet feeding operation. Simultaneously, the sheet feeding device controller 66 starts a timer to measure the time. Then, in a case in which the sheet feed sensor 17 does not detect any sheet even after a preset arrival time has passed, the sheet feeding device controller 66 determines the status as "misfeeding", that is, in this case, no sheet has been fed. Then, the sheet feeding device controller 66 causes to perform a paper jam handling and a retry sheet feeding, which is described below. Specifically, in the present embodiment, the sheet feed sensor 17 and the sheet feeding device controller 66 form a misfeeding detector to detect conveyance failure, that is, that failed sheet feeding, in other words, misfeeding has occurred. It is to be noted that in the embodiments of this disclosure, the status of misfeeding represents no sheet feeding, in particular.

When the sheet feed sensor 17 detects a sheet within a specified time, the sheet feeding device controller 66 sends the detection information in which the sheet feed sensor 17 has detected, to the host controller 67 of the image forming apparatus 100. The host controller 67 starts image formation based on the detection information of the sheet feed sensor 17. There may be a case in which the sheet reaches the sheet feed sensor 17 after the preset arrival time but by the start of image formation at the determination of misfeeding. At this time, the determination of misfeeding is not changed and the detection time information by the amount of delay of time is stored as reference information.

Further, in a case in which sheet feed sensor 17 does not detect the leading end of a sheet during a period of time from the start of the start of the sheet feeding operation to the set arrival time of the sheet, sheet feeding device controller 66 determines the status is misfeeding. Then, the sheet feeding device controller 66 causes the rotation of each fan and the driving of the belt motor 61 to stop and terminates the sheet feeding operation. In a case in which the retry sheet feeding is set, the number of rotations (outputs) of each fan and the speed of the suction belt 21 are changed to perform the retry sheet feeding. The details of the retry sheet feeding are described below. The number of rotations (outputs) of each fan may be adjusted by adjusting a drive voltage to be applied to each fan or by adjusting a duty ratio by the PWM control. Alternatively, the speed of the suction belt 21 may be adjusted by adjusting a drive voltage to be applied to the belt motor 61 or by adjusting a duty ratio by the PWM control.

When a paper jam is detected in the sheet feeding device 200, jam detection information is sent to the host controller 67. Upon reception of the jam detection information, the host controller 67 stops the image formation and displays jam information that indicates the position of occurrence of the paper jam, on the display 122 of the control unit 124. Further, when a paper jam occurs in the image forming apparatus 100, the host controller 67 sends jam information to the sheet feeding device controller 66. Based on the jam information, the sheet feeding device controller 66 performs control to the sheet feeding device 200 to stop the sheet feeding operation.

The sheet feeding device controller 66 includes a sheet feed information memory 68 that functions as a memory to store sheet feed information. Each time a sheet is fed, the sheet feed information obtained on sheet feeding is stored and accumulated in the sheet feed information memory 68. The sheet feed information that is stored in the sheet feed information memory 68 includes information related to a sheet feeding status, sheet feed setting information, and sheet feeding conditions.

Information related to the sheet feeding status includes the result of success or failure (misfeeding) of sheet feeding, the actual acceleration of the suction belt 21, the actual speed of the suction belt 21, the actual number of rotations of each fan (i.e., the floating fan 62, the separation fan 63, the side floating fan 71, the upward suction fan 64, and the downward suction fan 69), the actual arrival time of the sheet to the sheet feed sensor 17 from the start of the sheet feeding operation, the actual height of sheet loading table 11, the number of use (sheet feeding) of the sheet loading table 11, and the floating detection result of the floating detection sensor 16. The actual acceleration and the actual speed of the suction belt 21 are obtained based on the detection result of the rotation amount detecting device 2 that detects the number of rotations of the tension roller 22*a*. Further, the actual number of rotations of each fan is detected by the rotation amount detecting device 2 that is mounted on each fan. The height of the sheet loading table 11 corresponds to a height having height reference (that is, the height equals to zero) in which the sheet loading table 11 is located at the lowest position. The actual height of the sheet loading table 11 is obtained based on the detection result of the rotation amount detecting device 2 that is provided to the lifting drive unit 65.

The sheet feed setting information includes the drive voltage of the belt motor 61, the drive voltage to each fan, the set arrival time, and the set height of the sheet loading table 11. Further, the set acceleration of the suction belt 21 and the set number of rotations of each fan may be included as the sheet feed setting information, in the sheet feed information.

The sheet feeding conditions includes the sheet information and the user setting information. The sheet information includes, for example, sheet size, thickness, and type (e.g., glossy paper, plain paper, coated paper, label paper, OHP film sheet, film, multi-layered sheet, metallic sheet, processed sheet, etc.). The user setting information includes is, for example, information, such as the high speed mode and the low speed mode, set by the user via the control unit 124.

Further, the sheet feed information is divided into successful sheet feed information that includes information of successful sheet feeding and failed sheet feed information (misfeed information) that includes information of failed sheet feeding (i.e., misfeeding). The failed sheet feed information also includes setting change information on the retry sheet feeding.

In the present embodiment, a user uses the control unit 124 to change the setting to the retry sheet feeding to perform the sheet feeding operation again for multiple times in a case in which no sheet has reached the sheet feed sensor 17 and the status is determined as "misfeeding." By setting the retry sheet feeding, the ratio of occurrence of paper jam, and therefore the number of times for the user to handle the paper jam is reduced.

Figure 7:
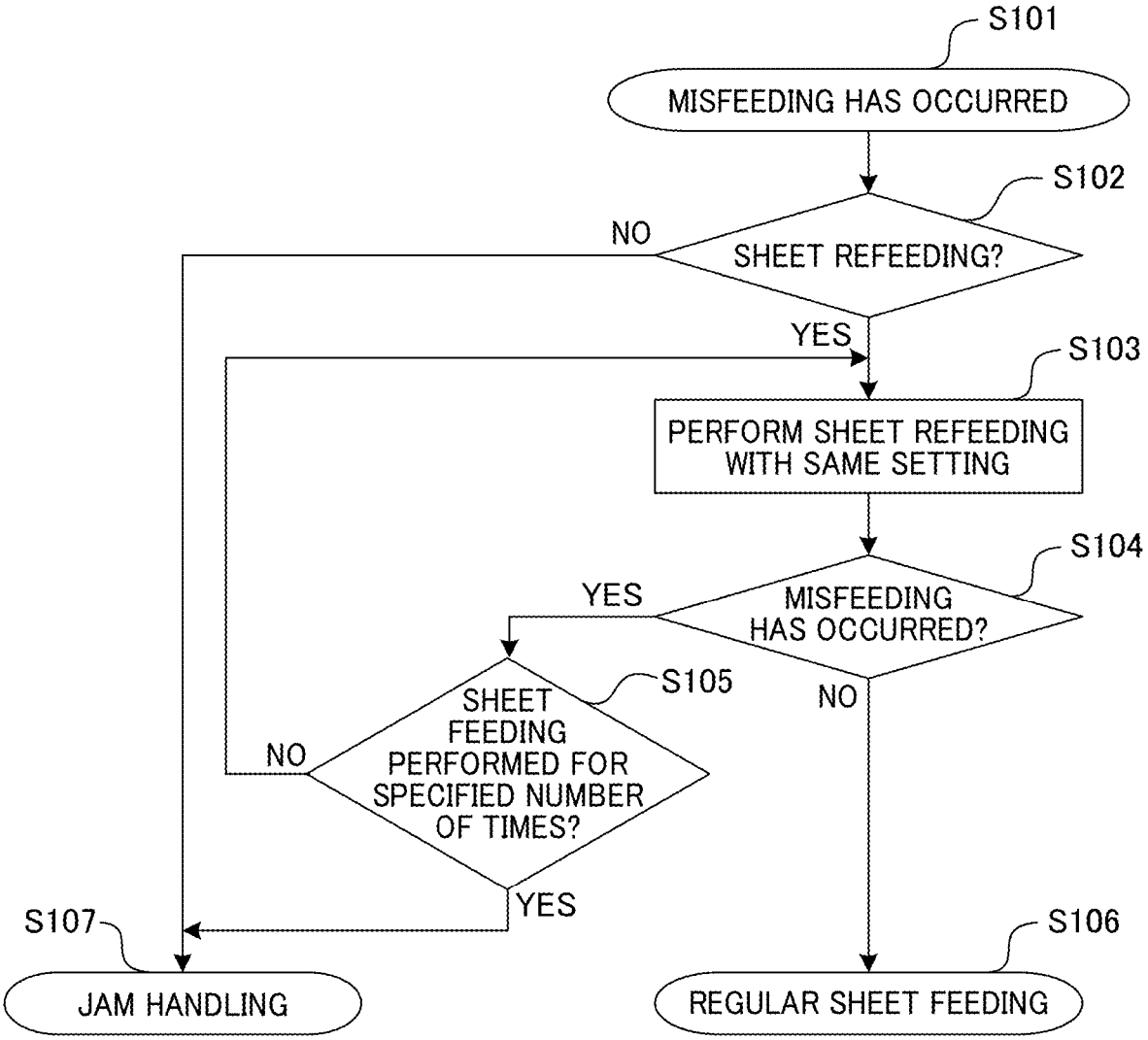
FIG. 7 is a control flowchart of an example of a comparative retry sheet feeding.

FIG. 7 is a control flowchart illustrating an example of a comparative retry sheet feeding.

As illustrated in FIG. 7, in the comparative retry sheet feeding, misfeeding has occurred (step S101), and it is determined whether the refeed setting has been made (step S102). When the refeed setting has been made (YES in step S102), sheet refeeding is performed in the same setting as the sheet feeding prior to the retry sheet feeding, which is the previous setting that has caused misfeeding (step S103). Then, it is determined whether misfeeding has occurred (step S104). When misfeeding has not occurred (NO in step S104), the process moves to regular sheet feeding (step S106). When misfeeding has occurred (YES in step S104), it is determined whether misfeeding is not cancelled (in other words, a state of misfeeding continues) after the retry sheet feeding has been attempted by a specified number of times (step S105). When misfeeding is not cancelled after the retry sheet feeding by a specified number of times (YES in step S105) or when the refeed setting has not been made (NO in step S102), a jam handling is performed (step S107).

However, in the comparative retry sheet feeding, in a case in which the relation of the drive voltage and the number of rotations of the floating fan 62, for example, is changed due to deterioration of the floating fan 62, the set drive voltage to the floating fan 62 cannot provide the target number of rotations of the floating fan 62, and therefore the insufficient floating occurs to cause misfeeding. In this case, the insufficient floating is not adjusted, and it is highly likely that, even if the retry sheet feeding is performed for the specified number of times, a sheet cannot be fed. As a result, it is highly likely to cause paper jam, and the rate of occurrence of paper jam cannot be sufficiently decreased.

Figure 8:
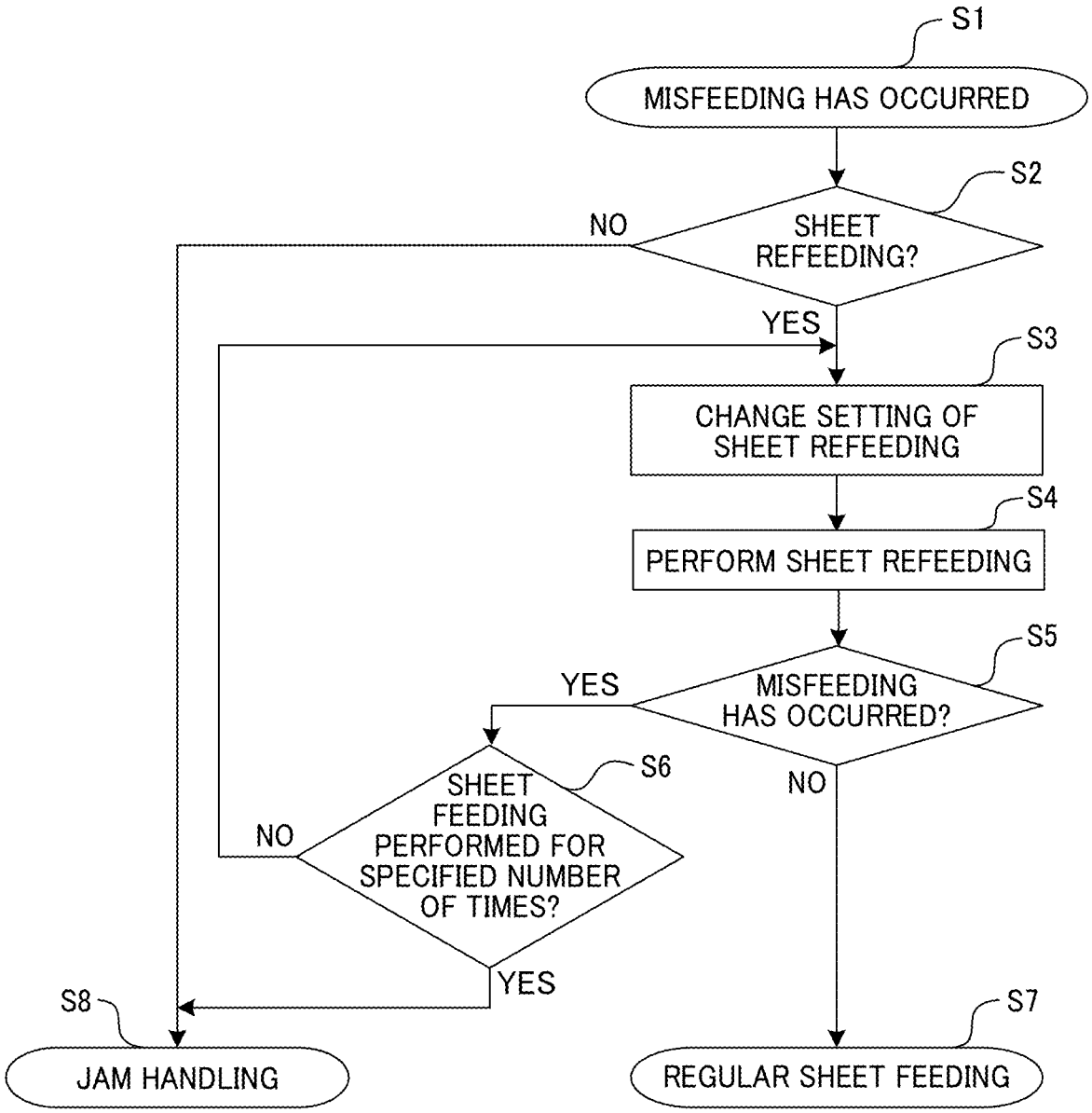
FIG. 8 is a control flowchart of a simple flow of a retry sheet feeding according to Embodiment 1.

FIG. 8 is a control flowchart illustrating a flow of retry sheet feeding according to the present embodiment.

As illustrated in FIG. 8, in the present embodiment, misfeeding has occurred (step S1), and it is determined whether the refeed setting has been made (step S2). When the refeed setting has been made (YES in step S2), a sheet feed setting is changed (step S3), and the retry sheet feeding is performed (step S4). Then, it is determined whether misfeeding has occurred (step S5). When misfeeding has not occurred (NO in step S5), the process moves to regular sheet feeding (step S7). By contrast, when misfeeding has occurred (YES in step S5), it is determined whether misfeeding is not cancelled (in other words, a state of misfeeding continues) after the retry sheet feeding has been attempted by a specified number of times (step S6). When misfeeding is not cancelled after the retry sheet feeding by a specified number of times (YES in step S6) or when the refeed setting has not been made (NO in step S2), a jam handling is performed (step S8).

As described above, different from the control flow of the comparative retry sheet feeding, in the present embodiment, the setting of the sheet feeding is changed to perform the retry sheet feeding. When changing the sheet feed setting in the present embodiment, the setting of the sheet feed setting for the retry sheet feeding is changed based on sheet feed information stored, for example, in a memory, as described below. Accordingly, the sheet feeding conditions for the retry sheet feeding actively change when the retry sheet feeding continues in a case in which the retry sheet feeding is repeated. By so doing, the retry sheet feeding is reliably performed, and therefore the rate of occurrence of paper jam is reduced.

Table 1 indicates the causes of misfeeding and the structural factors to generate the causes of misfeeding.

TABLE 1

| Structural Factor | | Cause of Misfeeding Misfeeding Error | | |
|---|---|---|---|---|
| | | Sheet | Insufficient Floating | Conveyance System |
| Sheet Characteristics | | GOOD | — | — |
| Failure in Lifting and Lowering Sheet Loading Table | | — | GOOD | — |
| Insufficient Air in Front Air Blowing Device | | — | GOOD | — |
| Insufficient Air in Side Air Blowing Device | | — | GOOD | — |
| Sheet Feeding Unit | Insufficient Air Suction | — | GOOD | — |
| | Belt Wear | — | — | GOOD |
| | Belt Motor | — | — | GOOD |
| Insufficient Time of Detection by Sensor | | — | — | GOOD |

As indicated by Table 1, the causes of misfeeding are classified to causes related to the sheet characteristics, causes related to insufficient floating, and causes related to sheet conveyance of the suction belt 21. The causes of the sheet characteristics relate to, for example, a heavy-weight sheet such as a thick paper having characteristics difficult to attach to the suction belt 21 and a sheet having characteristics with strong adhesion between sheets and difficult to float. According to these sheet properties, the uppermost sheet is difficult to attach to the suction belt 21, resulting in misfeeding.

In order to remove the causes of misfeeding related to the sheet characteristics, when performing the retry sheet feeding, the outputs (i.e., the drive voltage and the duty ratio) of the floating fan 62 and the outputs (i.e., the drive voltage and the duty ratio) of the side floating fan 71 are increased to enhance the force to lift up the sheet or the outputs (i.e., the drive voltage and the duty ratio) of the upward suction fan 64 are increased to enhance the air drawing force to the sheet. Further, the set height of the sheet loading table 11 is increased to move the sheet loading table 11 further upwardly, so that the uppermost sheet reaches the suction belt 21 more easily.

As indicated by Table 1, the insufficient floating is caused by a decrease in the number of rotations of each fan (e.g., the floating fan 62, the side floating fan 71, and the separation fan 63) due to deterioration and a decrease in the amount of air of the front air blowing device 26 and the side air blowing device 27 to be blown to the sheet, due to, for example, foreign materials blocking the nozzle of each device. The insufficient floating is also caused by a failure in elevation of the sheet loading table 11 in which the sheet loading table 11 is not sufficiently lifted to the set height due to deterioration of the lifting drive unit 65. Further, the insufficient floating is also caused by a decrease in the number of rotations of the upward suction fan 64 due to deterioration and insufficient air drawing of the upward suction device 23 due to foreign materials blocking an air drawing opening or air drawing openings of the upward suction device 23.

In order to remove the causes of misfeeding related to the insufficient floating, when performing the retry sheet feeding, the outputs (i.e., the drive voltage and the duty ratio) of the floating fan 62 and the outputs (i.e., the drive voltage and the duty ratio) of the side floating fan 71 are increased to enhance the force to lift up the sheet or the outputs (i.e., the drive voltage and the duty ratio) of the upward suction fan 64 are increased to enhance the air drawing force to the sheet. Further, the set height of the sheet loading table 11 is increased to move the sheet loading table 11 further upwardly, so that the uppermost sheet reaches the suction belt 21 more easily. Furthermore, the outputs of the separation fan 63 is increased to increase the strength to press the uppermost sheet to the suction belt 21, so that the uppermost sheet is attached to the suction belt 21 more easily.

The causes related to sheet conveyance of the suction belt 21 include wear of the suction belt 21. Due to wear of the suction belt 21, the friction with the sheet is decreased. After the sheet is attached to the suction belt 21, when the driving of the suction belt 21 is started, the suction belt 21 slips on the sheet. Therefore, the sheet fails to reach the sheet feed sensor 17 within the range of the set arrival time, resulting in misfeeding. The causes related to sheet conveyance of the suction belt 21 also include a decrease in the speed of the suction belt 21 and a decrease in the acceleration of the suction belt 21, due to deterioration of the belt motor 61. When the speed of the suction belt 21 and the acceleration of the suction belt 21 are decreased due to deterioration of the belt motor 61, the sheet fails to reach the sheet feed sensor 17 within the range of the set arrival time, resulting in misfeeding. The causes related to sheet conveyance of the suction belt 21 further include a short range of the set arrival time.

In order to remove the causes of misfeeding related to the sheet conveyance (of the suction belt 21), when performing the retry sheet feeding, the outputs (i.e., the drive voltage and the duty ratio) of the belt motor 61 are changed to modify he acceleration of the suction belt 21 and the speed of the suction belt 21 or the range of the set arrival time is extended.

Figure 9:
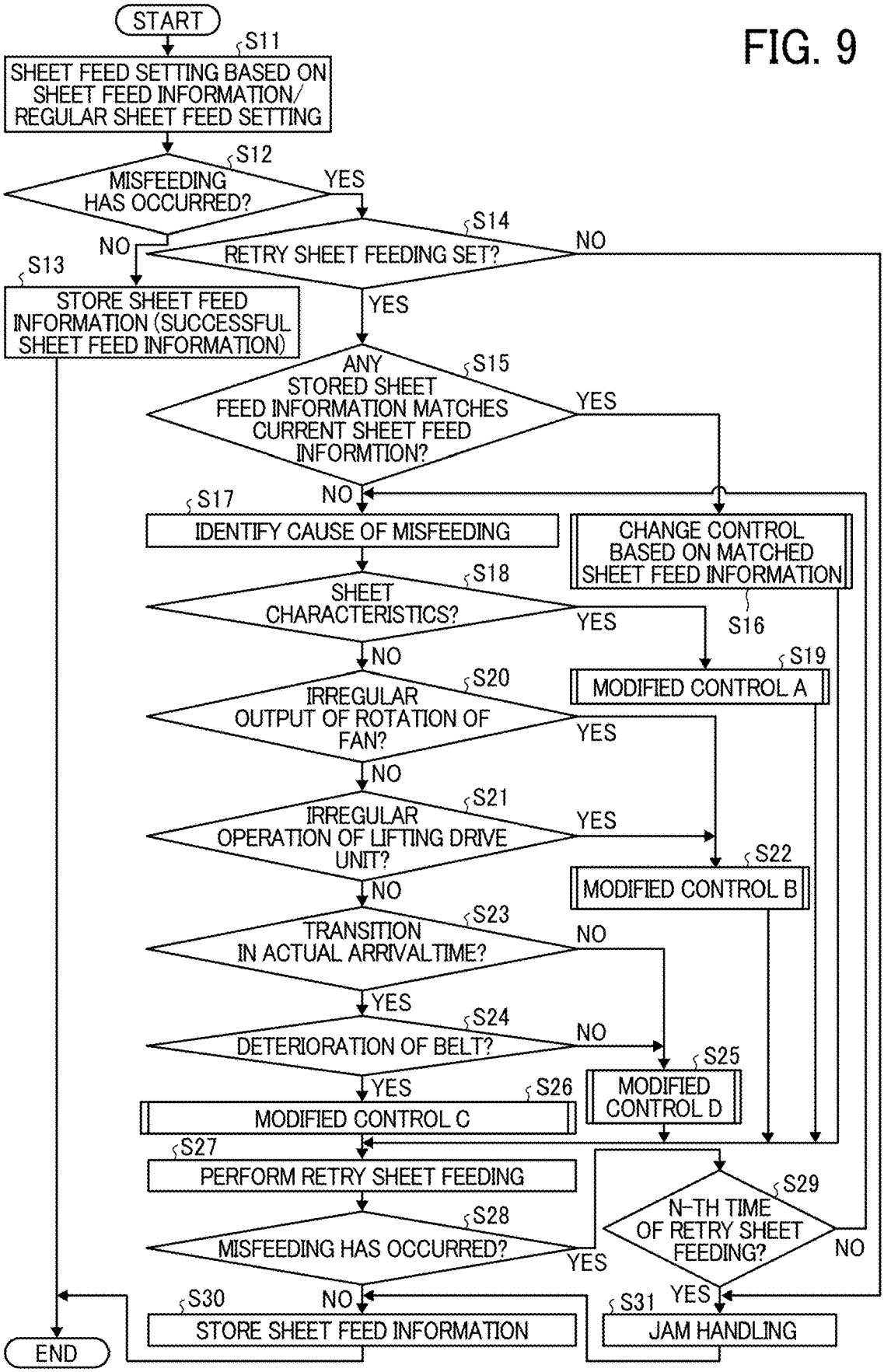
FIG. 9 is a flowchart of a specific example of sheet feed control performed by the sheet feeding device.

FIG. 9 is a flowchart illustrating a specific example of sheet feed control performed by the sheet feeding device 200.

As illustrated in FIG. 9, the outputs (i.e., the drive voltage and the duty ratio) of the belt motor 61, the outputs (i.e., the drive voltage and the duty ratio) of each fan, the outputs (i.e., the drive voltage and the duty ratio) of the lift motor of the lifting drive unit 65, the set arrival time, and the set height of the sheet loading table 11 are set for sheet feeding (in other words, a sheet feed setting), based on the sheet feeding conditions including the sheet information (for example, the sheet type, thickness, and size) and the sheet setting information (for example, image forming modes such as a high speed mode and a low speed mode) set by a user via the control unit 124 (step S11). At this time, in a case in which any sheet feeding condition that is the same as the current sheet feeding conditions is found in the successful sheet feeding information stored in the sheet feed information memory 68, the outputs (i.e., the drive voltage and the duty ratio) of the belt motor 61, the outputs (i.e., the drive voltage and the duty ratio) of each fan, the outputs (i.e., the drive voltage and the duty ratio) of the lift motor of the lifting drive unit 65, the set arrival time, and the set height of the sheet loading table 11 are set for sheet feeding, based on the sheet feed setting information of the sheet feed information. In a case in which multiple sets of successful sheet feed information under the same sheet feeding conditions as the current sheet feeding conditions are stored in the sheet feed information memory 68, the outputs (i.e., the drive voltage and the duty ratio) of the belt motor 61, the outputs (i.e., the drive voltage and the duty ratio) of each fan, the outputs (i.e., the drive voltage and the duty ratio) of the lift motor of the lifting drive unit 65, the preset arrival time, and the set height of the sheet loading table 11 are set for the sheet feeding, based on the sheet feed setting information of the newest sheet feed information (with the largest number of uses).

By contrast, in a case in which misfeeding conditions that are the same as the current sheet feeding conditions are found in the successful sheet feeding information stored in the sheet feed information memory 68, regular sheet feeding (i.e., a predetermined sheet feeding operation) is performed.

When the sheet has reached the sheet feed sensor 17 within the range of the set arrival time (NO in step S12), the current sheet feed information is stored as the successful sheet feed information in the sheet feed information memory 68 (step S13). To be more specific, information related to the sheet feeding state (e.g., the successful information of sheet feeding, the actual acceleration of the suction belt 21, the actual speed of the suction belt 21, the actual number of rotations of each fan, the actual arrival time, the actual height of the sheet loading table 11, and the number of uses), the sheet feeding conditions (e.g., the sheet information and the user setting information), and the sheet feed setting information (e.g., the outputs of the belt motor 61, the outputs of each fan, the outputs of the lift motor of the lifting drive unit 35, the set arrival time, and the set height) are associated with each other and are stored in the sheet feed information memory 68 as the successful sheet feed information.

By contrast, when the sheet has not reached the sheet feed sensor 17 to be resulted in misfeeding (YES in step S12), it is determined whether the retry sheet feeding is set (step S14). When the retry sheet feeding is not set (NO in step S14), the paper jam handling is performed and an information message indicating that the paper jam has occurred is displayed on the control unit 124 of the image forming apparatus 100 (step S29).

By contrast, when the retry sheet feeding is set (YES in step S14), the control to change the sheet feed setting is performed in the retry sheet feeding. First, it is determined whether any sheet feed information among the failed sheet feed information stored in the sheet feed information memory 68 is identical to the current sheet feed information (step S15). For example, sheet feed information that is identical to any information other than the number of uses may be found among the failed sheet feed information. Alternatively, sheet feed information that is identical to some information included in the sheet feed information such as sheet information and information related to the sheet feeding state may be found among the failed sheet feed information. Accordingly, the failed sheet feed information that matches the current sheet feed information has a high possibility of occurrence of misfeeding generated by the same cause as the current sheet feed information.

As described above, the failed sheet feed information is associated with the sheet feed setting information changed in the retry sheet feed setting information at the time of the retry sheet feeding is also stored in association with the failed sheet feed information and stored in the memory. Therefore, when sheet feed information among the failed sheet feed information stored in the sheet feed information memory 68 is found to be identical to the current sheet feed information (YES in step S15), the modified sheet feed setting information that stored in association with the failed sheet feed information that matches the current sheet feed information is read to perform a modified control to modify the sheet feed setting information to the read sheet feed setting information (step S16). Accordingly, the sheet feed setting is changed based on the cause of the current misfeeding. As described above, by performing the retry sheet feeding with the sheet feed setting based on the cause of misfeeding, the success rate of the retry sheet feeding is increased, and the jam rate is reduced.

When the sheet feed information among the failed sheet feed information stored in the sheet feed information memory 68 is not found to be identical to the current sheet feed information (NO in step S15), the causes of misfeeding is identified (step S17).

Then, it is determined whether the cause of misfeeding relates to sheet characteristics, for example, a sheet is changed and a sheet that has not been used before is set (step S18). When the cause of misfeeding relates to sheet characteristics (YES in step S18), the modified control A is performed (step S19).

When the cause of misfeeding does not relate to sheet characteristics (NO in step S18), it is determined whether the actual number of rotations of the fan is in a specified range, in other words, whether the cause of misfeeding relates to irregular output of rotations of the fan (step S20). When the cause of misfeeding does not relate to irregular output of rotations of the fan (NO in step S20), it is then determined whether the actual height of the sheet loading table 11 is in a specified range, in other words, whether the cause of misfeeding relates to irregular operation of the lifting drive unit 65 (step S21). When the cause of misfeeding relates to irregular operation of the lifting drive unit 65 (NO in step S21), the process moves to step S23. When the cause of misfeeding relates to abnormal output of rotations of the fan (YES in step S20) or when the cause of misfeeding relates to irregular operation of the lifting drive unit 65 (YES in step S21), the modified control B is performed (step S22).

By contrast, when the cause of misfeeding does not relate to irregular output of rotations of the fan (NO in step S20) or when the cause of misfeeding does not relate to irregular operation of the lifting drive unit 65 (NO in step S21), it is determined that the cause of misfeeding relates to the belt conveyance system. The causes of the belt conveyance system are classified into deterioration (wear) of the suction belt, deterioration of the belt motor, and other factors. In a case in which deterioration (wear) of the suction belt 21 relates to the cause of the belt conveyance system, as the deterioration (wear) of the suction belt 21 advances, the slip rate of the suction belt 21 and a sheet rises. Consequently, as the number of times of use of the suction belt 21 increases, the actual arrival time from a time in which sheet feeding starts to a time in which the leading end of the sheet reaches sheet feed sensor 17 increases. Therefore, the number of times of use of the suction belt 21 has a proportional relation with the actual arrival time. Similarly, in a case in which deterioration of the belt motor relates to the cause of the belt conveyance system, as deterioration advances, the rotation speed of the suction belt 21 decreases. Consequently, as the number of times of use of the suction belt 21 increases, the actual arrival time from a time in which sheet feeding starts to a time in which the leading end of the sheet reaches sheet feed sensor 17 increases. Therefore, the number of times of use of the suction belt 21 has a proportional relation with the actual arrival time.

Specifically, the relation of the number of times of use of the suction belt 21 and the actual arrival time is obtained from the sheet feed information stored and accumulated in the sheet feed information memory 68. Then, it is checked whether the current actual measured time is correlated with the obtained relation of the number of times of use of the suction belt 21 and the actual arrival time. To be more specific, it is determined that there is a correlation between the current actual measured time and the obtained relation of the number of times of use of the suction belt 21 and the actual arrival time in a case in which the actual number of rotations of the fan at the current misfeeding falls within the margin of error on a line of relationship obtained from the sheet feed information (i.e., on a straight line in a primary function) stored in the sheet feed information memory 68, with the number of times of use of the suction belt 21 being indicated on the horizontal axis and the actual number of rotations of the fan being indicated on the vertical axis.

The actual arrival time can be measured even when the leading end of the sheet has not passed by the preset arrival time to be determined as "misfeeding". This measurement of the actual arrival time is performed because of the following reasons. There is a predetermined time lag until it is determined that "misfeeding" to start the termination of the sheet feeding. If the leading edge of the sheet passes the sheet feed sensor 17 during this time, the actual arrival time can be measured. Consequently, the actual arrival time can be measured even in the case of "misfeeding." In particular, if the wear of the suction belt 21 is the cause, the actual arrival time gradually delays. Therefore, it is highly likely that the leading end of the sheet reaches the sheet feed sensor 17 during the predetermined time lag from the determination of "misfeeding" to the start of termination of the sheet feeding.

Then, when the current actual arrival time has a correlation with the relation of the number of times of use of the suction belt and the actual arrival time, it is determined whether there is a transition in the current actual arrival time to extend as the number of times of use of the suction belt increases (step S23). When there is no transition in the current actual arrival time (NO in step S23), it is determined that the cause of misfeeding is other than deterioration of the suction belt or the belt motor and the modified control D is performed (step S25).

By contrast, when there is a transition in the current actual arrival time (YES in step S23), it is determined whether there is deterioration (wear) of the suction belt (step S24). When the actual acceleration and the actual speed of the suction belt 21 fall within a specified range, it is determined that there is deterioration (wear) of the suction belt 21 (YES in step S24), the modified control C is performed (step S26). By contrast, when the actual acceleration and the actual speed of the suction belt 21 are out of the specified range, it is determined that there is no deterioration (wear) of the suction belt 21 (NO in step S24), the modified control D is performed (step S25).

In the above description, the causes are identified in the order of the sheet characteristics, the irregular operation of the fan, the irregular operation of the lifting drive unit 65, and the irregular operation of the belt conveyance system. However, the order of the cause identification is not limited to this order. For example, identification of these causes may be performed in parallel. Thus, the cause identification may be performed in parallel, and, for example, both the insufficient floating and the sheet characteristics may be the causes, a modified control AB that is a combination of the modified control A and the modified control B may be performed. In the modified control AB, for example, the first modification item in the modified control A and the first modification item of the modified control B are performed simultaneously. Further, the cause of the misfeeding that is currently occurring may be identified from the sheet feed information stored in the sheet feed information memory 68, so that the causes of misfeeding are specified in the order of high frequency of occurrence.

Table 2 indicates modified controls A, B, C, and D that correspond to causes of misfeeding and the items to be modified for each modified control.

TABLE 2

| | | Retry Sheet Feeding | | | |
|---|---|---|---|---|---|
| Cause of Misfeeding | | Sheet Characteristics | Insufficient Floating | Belt Wear | Conveyance System |
| Modified Control | | A | B | C | D |
| Increase of Number of Times of Retry Sheet Feeding | | GOOD | GOOD | GOOD | GOOD |
| Floating Device | Increase of Output of Floating Fan | GOOD | GOOD | — | — |
| | Increase of Output of Side Floating Fan | GOOD | GOOD | — | — |

TABLE 2-continued

| Cause of Misfeeding | | Retry Sheet Feeding | | | |
|---|---|---|---|---|---|
| | | Sheet Characteristics | Insufficient Floating | Belt Wear | Conveyance System |
| Lifting Device | Additional Control in Lifting and Lowering Sheet Loading Table | GOOD | GOOD | — | — |
| Suction Device | Increase of Output of Fan | GOOD | GOOD | — | — |
| Belt | Increase of Acceleration | — | — | — | GOOD |
| | Increase of Speed | — | — | GOOD | GOOD |
| | Decrease of Speed | — | — | — | GOOD |
| | Decrease of Acceleration | — | — | GOOD | GOOD |
| Sensor | Extension of Preset Arrival Time | — | — | GOOD | GOOD |
| Encourage Replacement of Parts | | — | GOOD | GOOD | GOOD |

As identified in Table 2, in a case in which the cause of misfeeding relates to the sheet characteristics, the sheet has a characteristic difficult to be sucked to the suction belt 21, for example, a heavy sheet such as a thick paper or the sheet has a characteristic to stick sheets together to be difficult to float. Accordingly, when the sheet characteristics are the causes of misfeeding, the items to be changed in the setting of the modified control A to be performed are the increase in output (i.e., the drive voltage and the duty ratio) of the floating fan 62, the increase in output (i.e., the drive voltage and the duty ratio) of the side floating fan 71, the increase of output (i.e., the drive voltage and the duty ratio) of the upward suction fan 64, and the lifting of the sheet loading table 11. By increasing the outputs of the floating fan 62 and the side floating fan 71, force to lift the sheet is enhanced to preferably float the sheet having the characteristic difficult to be floated, and therefore occurrence of misfeeding is eliminated. Further, by increasing the output of the upward suction fan 64, the sheet having the characteristic difficult to be sucked to the suction belt 21 is sucked to the suction belt 21, and therefore occurrence of misfeeding is eliminated. Further, by increasing the setting height of the sheet loading table 11, the uppermost sheet reaches the suction belt 21 easily, and therefore occurrence of misfeeding is eliminated.

Alternatively, the output of the separation fan 63 may be increased. By increasing the output of the separation fan 63, force to lift the uppermost sheet toward the suction belt 21 is increased, and therefore the sheet having the characteristic difficult to be floated is floated to the suction belt 21.

The same changes as the modified control A are made when changing the setting of the modified control B that is performed when the irregular operation of the fan or the irregular operation of the lifting drive unit 65 are the causes of misfeeding. Specifically, the output of the floating fan 62 and the output of the side floating fan 71 are increased, the force to float the sheet is enhanced, the output of the upward suction fan 64 is increased, and the suction force to the sheet is enhanced. Further, the set height of the sheet loading table 11 is increased, so that the uppermost sheet reaches the suction belt 21 easily.

Alternatively, the output of the separation fan 63 may be increased. By increasing the output of the separation fan 63, force to lift the uppermost sheet toward the suction belt 21 is increased, and therefore the insufficient floating of the sheet is eliminated.

When the deterioration (wear) of the suction belt is the cause of misfeeding, the items to be changed in the setting of the modified control C to be performed are the extension of the preset arrival time, the decrease in the belt acceleration, and the increase in the belt speed. As described above, as the wear of the suction belt 21 advances, the slip rate of the suction belt 21 and the sheet increases, which causes a delay in arrival time, resulting in misfeeding. Therefore, by extending the preset arrival time, even if the sheet slips on the suction belt 21 due to wear of the suction belt 21, the leading end of the sheet reaches the sheet feed sensor 17 by the preset arrival time, and therefore misfeeding is eliminated.

In addition, by reducing the belt acceleration, slippage between the sheet and the suction belt 21 is restrained, and therefore the sheet conveyance performance is enhanced. Accordingly, the leading end of the sheet reaches the sheet feed sensor 17 by the preset arrival time. Further, by increasing the speed of the suction belt 21, even if the sheet slips on the suction belt 21 due to the wear of the suction belt 21, the leading end of the sheet reaches the sheet feed sensor 17 by the preset arrival time, and therefore occurrent of misfeeding is eliminated.

When the causes of misfeeding relate to the sheet conveyance system other than the deterioration (wear) of the suction belt, the items to be changed in the setting of the modified control D are the extension of the preset arrival time, the increase and decrease in the belt acceleration, and the increase and decrease in the belt speed. By performing the whole items related to the sheet conveyance of the suction belt 21, occurrence of misfeeding is eliminated when the sheet conveyance system is the cause of misfeeding.

Tables 3 to 6 below indicate examples of the number of times of retry and the items to be changed in the modified controls A, B, C, and D.

TABLE 3

| | A | | | | | | |
|---|---|---|---|---|---|---|---|
| | 1st time | 2nd time | 3rd time | . . . | n-1th time | nth time | Paper Jam Handling |
| Increase Number of Times of Retry Sheet Feeding | GOOD | GOOD | GOOD | . . . | GOOD | GOOD | — |

TABLE 3-continued

| | | A | | | | | | |
|---|---|---|---|---|---|---|---|---|
| | | 1st time | 2nd time | 3rd time | . . . | n-1th time | nth time | Paper Jam Handling |
| Floating Device | Increase of Output of Floating Fan | GOOD | — | — | . . . | GOOD | GOOD | — |
| | Increase of Output of Side Floating Fan | GOOD | — | — | . . . | GOOD | GOOD | — |
| Lifting Device | Additional Control in Lifting and Lowering Sheet Loading Table | — | — | GOOD | . . . | . . . | GOOD | — |
| Air Drawing Device | Increase of Output of Upward Suction Fan | — | GOOD | — | . . . | GOOD | GOOD | — |
| Check of Sheet Setting | | — | — | — | — | — | — | GOOD |

TABLE 4

| | | B | | | | | |
|---|---|---|---|---|---|---|---|
| | | 1st time | 2nd time | 3rd time | . . . | nth time | Paper Jam Handling |
| Increase of Number of Times of Retry Sheet Feeding | | GOOD | GOOD | GOOD | . . . | GOOD | — |
| Floating Device | Increase of Output of Floating Fan | GOOD | — | — | . . . | GOOD | — |
| | Increase of Output of Side Floating Fan | GOOD | — | — | . . . | GOOD | — |
| Lifting Device | Additional Control in Lifting and Lowering Sheet Loading Table | — | — | GOOD | . . . | GOOD | — |
| Suction Device | Increase of Output of Upward Suction Fan | — | GOOD | — | . . . | GOOD | — |
| Promotion to Repair of Device | | — | — | — | — | — | GOOD |

TABLE 5

| | | C | | | | | |
|---|---|---|---|---|---|---|---|
| | | 1st time | 2nd time | 3rd time | . . . | nth time | Paper Jam Handling |
| Increase of Number of Times of Retry Sheet Feeding | | GOOD | GOOD | GOOD | . . . | GOOD | — |
| Belt | Decrease of Acceleration | — | GOOD | — | . . . | GOOD | — |
| | Increase of Speed | — | — | GOOD | . . . | GOOD | — |
| Sensor | Extension of Time of Arrival | GOOD | — | — | . . . | GOOD | — |
| Promotion to Replacement of Suction Belt | | — | — | — | — | — | GOOD |

TABLE 6

| | | D | | | | | |
|---|---|---|---|---|---|---|---|
| | | 1st time | 2nd time | 3rd time | . . . | nth time | Paper Jam Handling |
| Increase of Number of Times of Retry Sheet Feeding | | GOOD | GOOD | GOOD | . . . | GOOD | — |
| Belt | Increase of Acceleration | — | GOOD | — | . . . | — | — |
| | Increase of Speed | — | — | — | . . . | GOOD | — |
| | Decrease of Speed | — | — | GOOD | | — | — |
| | Decrease of Acceleration | — | — | — | | GOOD | — |
| Sensor | Extension of Time of Arrival | GOOD | — | — | . . . | GOOD | — |
| Promotion to Replacement of Sheet Feeding Unit | | — | — | — | . . . | — | GOOD |

As indicated in Table 3 through Table 6, in the retry sheet feeding performed for multiple times in an initial stage, one setting of the multiple modification items is changed to perform the retry sheet feeding. For example, in the modified control A and the modified control B, the modification items of the floating device are changed (that is, increase of outputs of the floating fan 62 and the side floating fan 71) among the modification items of the floating device, the lifting device, and the suction device, at the first retry sheet feeding. When performing the second retry sheet feeding, it is considered that misfeeding has occurred due to a cause or causes other than the floating device. Therefore, the outputs of the floating fan 62 and the side floating fan 71 are reset to the previous settings, and the suction device is changed to increase the output of the upward suction fan 64 before performing the second retry sheet feeding.

Tables 3 to 6 above are examples. Regarding the output of each fan, the operation of which can be finely adjusted, the set height of the sheet loading table 11, the speed of the suction belt, the acceleration of the suction belt, and the preset arrival time of the leading end of the sheet to reach the sheet feed sensor 17, respective amounts of increases may be increased according to the number of times of retry sheet feedings.

After one of the items are changed among multiple items to be changed, the retry sheet feeding is performed (step S27). Then, it is determined whether misfeeding occurs, in other words, whether misfeeding is not eliminated (step S28). When misfeeding occurs (is not eliminated) (YES in step S28) and the retry sheet feeding is not performed (NO in step S29), two or more items among the multiple items to be changed are changed and then the retry sheet feeding is performed. For example, two of the items to be changed from the floating device, the lifting device, and the suction device in the modified control A and the modified control B. In a case in which misfeeding continues to occur even if the whole patterns of sets of two items of multiple settings to be changed (three patterns in the modified controls A and B, which are a pattern of the floating device and the lifting device, a pattern of the floating device and the suction device, and a pattern of the lifting device and the suction device), the number of items to be changed is increased and the retry sheet feeding is performed. Finally, the whole items to be changed are changed, and then the retry sheet feeding is performed (the nth retry sheet feeding). When misfeeding is not eliminated even if the whole items to be changed are changed and the retry sheet feeding is performed (YES in step S29), the jam handling is performed and a predetermined information message is displayed on the control unit of the image forming apparatus (step S31). Then, the sheet feed information is stored in the memory as reference information of the misfeeding (step S30).

As indicated in Table 3, in the modified control A, when occurrence of misfeeding is not eliminated, it is determined that this inconvenience is caused by enter of any foreign materials by chance or improper sheet setting. Consequently, an information message is displayed to make a user check enter of any foreign materials by chance or improper sheet setting, on the control unit 124 at the jam handling.

Further, as indicated in Table 4, in the modified control B, when occurrence of misfeeding is not eliminated, it is likely that the front air blowing device 26, the side air blowing device 27, and the upward suction device 23 are broken. Consequently, an information message is displayed to make a user repair the sheet feeding device 200, on the control unit 124 at the jam handling.

Further, as indicated in Table 5, in the modified control C, when occurrence of misfeeding is not eliminated, it is likely that the suction belt 21 has reached the end of the service life. Consequently, an information message is displayed to make a user replace the suction belt 21 to a new suction belt, on the control unit 124 at the jam handling.

Further, as indicated in Table 6, in the modified control D, when occurrence of misfeeding is not eliminated, it is likely that the sheet feeding unit 20 is broken. Consequently, an information message is displayed to make a user repair the sheet feeding unit 20, on the control unit 124 at the jam handling. In addition, since the floating detection sensor 16 is disposed upstream from the suction belt 21 in the sheet feeding direction, it is likely that the floating detection sensor 16 does not properly detect that the uppermost sheet is lifted to attracted to the suction belt 21. (Actually, even when the sheet is not attracted to the suction belt 21, the floating detection sensor 16 makes misdetection that the uppermost sheet is attached to the suction belt 21.) Therefore, in a case in which misfeeding remains even after the modified control D has been performed, the modified control B is performed, and the setting is changed to remove the cause of the insufficient floating.

For example, when misfeeding remains even after the irregular operations of the fans and the lifting drive unit 65 have been eliminated, the items of the first performance of the modified control C and the items of the first performance of the modified control D in Tables 5 and 6 are changed while the setting that removed the cause of the insufficient floating is maintained.

Further, in the present embodiment, the modified control A and the modified control B share the processes other than the process at the jam handling. However, the modified control A and the modified control B may have different processes from each other. For example, the item to be changed for the first retry sheet feeding in the modified control B may be the suction device and the item of the lifting device for the first retry sheet feeding in the modified control B may not be changed. Further, the increase in output of the separation fan 63 may be added as an item to be changed in the modified control A and the modified control B.

By contrast, when misfeeding is eliminated and the retry sheet feeding is performed successfully (NO in step S28), the setting change information is associated with the failed sheet feed information and is stored in the sheet feed information memory 68 and the sheet feed information on the retry sheet feeding is stored as successful sheet feed information in the sheet feed information memory 68 (step S30).

By storing the setting change information in association with the failed sheet feed information, when the same misfeeding occurs after this misfeeding, the setting change information of the failed sheet feed information is read to eliminate occurrence of misfeeding.

For example, assuming that insufficient floating caused by suction failure has occurred due to the lack of the number of rotations of the upward suction fan 64, misfeeding occurs. At this time, the modified control B is performed in the retry sheet feeding. Then, the output of the upward suction fan 64 is increased, and the number of rotations of the upward suction fan 64 is increased. Consequently, occurrence of misfeeding is eliminated at the second retry sheet feeding. At this time, the failed sheet feed information includes a lacked amount of the actual number of rotations of the upward suction fan 64 and information of the increase in output of the upward suction fan 64 as the setting change information. Then, when no misfeeding occurs again due to the insufficient number of rotations of the upward suction fan 64, the sheet feed information including the cause of misfeeding due to the insufficient number of rotations of the upward suction fan 64, among the sheet feed information stored in the sheet feed information memory 68, is read, in step S15 of FIG. 9, so that the setting change (i.e., the increase in output of the upward suction fan 64) is applied. Accordingly, the setting is quickly changed to an optimum sheet feed setting.

Further, by storing the sheet feed information at this retry sheet feeding in the sheet feed information memory 68 as successful sheet feed information, the sheet feed setting is made based on this sheet feed information at the subsequent sheet feeding. Accordingly, occurrence of misfeeding specified in step S17 is restrained. It is to be noted that the number of times of retry sheet feedings is stored as sheet feed information in the successful sheet feed information at this retry sheet feeding.

As described above, there are cases in which, after the leading end of a sheet does not reach the sheet feed sensor 17 by the preset arrival time and the state is determined as misfeeding, the leading end of the sheet reaches the sheet feed sensor 17 or the sheet is conveyed by the suction belt 21 to some extent. As the sheet feeding is stopped, the rotation of each fan is also stopped. Therefore, the portion of the sheet attached to the suction belt 21 falls on the sheet bundle P by the own weight of the sheet. At this time, the leading end side of the sheet may move in the direction opposite to the sheet feeding direction, and the uppermost sheet may return to the original position or may not completely return to the original position.

As described above, in a case in which the retry sheet feeding is performed while the uppermost sheet is not at the original position, the sheet is successfully fed (in other words, the leading end of the sheet reaches the sheet feed sensor 17 by the preset arrival time) even though the sheet feed setting is not optimum. Therefore, in a case in which the subsequent sheet feeding is performed with the sheet feed setting based on the successful sheet feed information on the retry sheet feeding, misfeeding occurs because of the same cause as the previous sheet feeding. Then, for the retry sheet feeding to remove the second misfeeding, if the first items to be changed are changed in the modified controls A through D, inappropriate items are to be changed again, and therefore it is likely that occurrence of misfeeding is not eliminated.

Therefore, in the present embodiment, the number of times of retry sheet feedings is also stored as sheet feed information in the successful sheet feed information on the retry sheet feeding. By so doing, when misfeeding occurs at the subsequent sheet feeding that is to be performed after the successful retry sheet feeding (i.e., the sheet feeding under the same sheet feeding conditions as the sheet feeding conditions at the previous misfeeding), it is determined that the setting changed at the previous retry sheet feeding is not optimal. Consequently, the setting of the subsequent items to be changed according to the number of times of retry sheet feedings in the sheet feed information that has been referred to at the sheet feed setting (for example, the second item to be changed if the previous sheet feeding resulted in success after one retry sheet feeding) is changed to the optimal settings.

In addition, in a case in which the actual values (such as the actual acceleration and the actual speed of the suction belt 21, the actual number of rotations of each fan, the actual arrival time, and the actual height of the sheet loading table 11) are out of a specified range (such as each fan, the lifting drive unit 65, and the belt motor), the outputs of these actual values are adjusted to fall within the specified range to perform the first retry sheet feeding. For example, when it is confirmed that the actual speed of the upward suction fan 64 and the actual speed of the suction belt 21 are out of the specified range, the outputs of the floating fan, the upward suction fan 64, and the belt motor are adjusted, and the first retry sheet feeding is performed. However, there may be a case that misfeeding occurs even after the above-described adjustments of outputs of the floating fan, the upward suction fan 64, and the belt motor and the first retry sheet feeding. In a case in which the floating detection sensor 16 has not detected attraction of the uppermost sheet to the suction belt 21 by the specified time, the modified control B is performed. In a case in which the floating detection sensor 16 has detected attraction of the uppermost sheet to the suction belt 21 by the specified time, the transition of the actual arrival time is observed. If there is the transition, the modified control C is performed. By contrast, if there is no transition, the modified control D is performed.

The causes of misfeeding are mainly divided into unexpected causes and deterioration of each unit (such as wear of the belt, deterioration of the fan, the belt motor, and the lift motor). However, deterioration of each unit may be determined by checking the transition based on the sheet feed information (that is, information related to the sheet feeding status) in stored in the sheet feed information memory 68. As deterioration advances, the actual arrival time gradually extends. Therefore, when the sheet feeding is performed for a certain period without any change of the sheet feeding conditions, the relation of the number of times of use of the unit obtained based on the sheet feed information stored in stored in the sheet feed information memory 68 and the actual arrival time becomes proportional, for example. Therefore, if there is a correlation between the relation of the number of times of use of the unit obtained based on the sheet feed information stored in the sheet feed information memory 68 and the actual arrival time (i.e., the transition of the actual arrival time) and the actual arrival time at the current misfeeding, it is presumed that deterioration of the unit is the cause of misfeeding.

As deterioration advances in the belt motor and the fan, the number of rotations of the belt motor and the fan decreases. Therefore, when the sheet feeding is performed for a certain period without any change of the sheet feeding conditions, the relation of the number of times of use of the fan obtained based on the sheet feed information stored in the sheet feed information memory 68 and the actual number of rotations of the fan and the relation of the number of times of use of the belt obtained based on the sheet feed information stored in the sheet feed information memory 68 and the speed of the belt becomes, for example, inversely proportional. In addition, as deterioration advances in the lift motor, the number of rotations of the lift motor decreases. Therefore, the actual height of the sheet loading table is gradually lowered, and the relation of the number of times of use of the lift motor obtained based on the sheet feed information stored in the sheet feed information memory 68 and the actual height of the sheet loading table becomes, for example, inversely proportional.

Therefore, when it is determined in step S23 of FIG. 9 that there is a transition in the actual arrival time, it is determined whether there is a correlation between the actual number of rotations of the fan in the current misfeeding and the relation of the number of times of use of the fan and the actual number of rotations of the fan, obtained based on the sheet feed information stored in the sheet feed information memory 68 (inversely proportional, for example). When there is the correlation, the cause of misfeeding may be determined due to the decrease in the number of rotations (the decrease in the number of rotations to the output values)

of the fans fan (the floating fan, the side floating fan, the separation fan, and the upward suction fan) caused by deterioration of the fans.

As described above, when the decrease in the number of rotations of the fans due to deterioration of the fans is determined as the causes of misfeeding, the output values (the drive voltage and the duty ratio) of the fan having the decrease in the number of rotations due to deterioration of the fan may be increased to perform the first retry sheet feeding. In addition, the output value may be increased each time the retry sheet feeding is performed. For example, the output is increased by 10% at the first retry sheet feeding and the output is increased by 20% compared to the misfeeding at the second retry sheet feeding.

For the belt motor 61, when it is determined in step S23 of FIG. 9 that there is a transition in the actual arrival time, it is determined whether there is a correlation between the actual speed of the belt at the current misfeeding and the predetermined relation of number of times of use of the belt motor and the actual speed of the belt, obtained based on the sheet feed information stored in the sheet feed information memory 68. When there is the correlation, the cause of misfeeding may be determined due to the decrease in the number of rotations of the belt motor caused by deterioration of the belt motor.

Similarly, when the decrease in the number of rotations of the belt motor due to deterioration of the belt motor is determined as the causes of misfeeding, the output values (the drive voltage and the duty ratio) of the belt motor having the decrease in the number of rotations due to deterioration of the belt motor may be increased to perform the first retry sheet feeding. Similar to the case of the fans, the output value may be increased each time the retry sheet feeding is performed. For example, the output is increased by 10% at the first retry sheet feeding and the output is increased by 20% compared to the misfeeding at the second retry sheet feeding.

Further, in the present embodiment, the height of the upper face of the uppermost sheet is detected by the lifting sensor 41. Then, the lift motor of the lifting drive unit 65 is driven for a predetermined time after the detection signal of the lifting sensor 41 is detected, and then is stopped. By so doing, the height of the sheet loading table is located at the set height. Accordingly, by decreasing the number of rotations of the lift motor due to deterioration of the lift motor, the actual height of the sheet loading table is gradually lowered. Therefore, the actual arrival time extends gradually.

Therefore, when it is determined in step S23 of FIG. 9 that there is a transition in the actual arrival time, it is determined whether there is a correlation between the actual height of the sheet loading table at the current misfeeding and the predetermined relation of the actual height of the sheet loading table and the number of times of use of the sheet loading table, obtained based on the sheet feed information stored in the sheet feed information memory 68. When there is the correlation, the cause of misfeeding may be determined due to the insufficient lifting of the sheet loading table 11 caused by deterioration of the lift motor.

As described above, when the insufficient lifting of the sheet loading table 11 due to deterioration of the lift motor is determined as the causes of misfeeding, the output values (the drive voltage and the duty ratio) of the lift motor having the decrease in the number of rotations due to deterioration of the lift motor may be increased to perform the first retry sheet feeding. Also in this case, the output value may be increased each time the retry sheet feeding is performed. For example, the output is increased by 10% at the first retry sheet feeding and the output is increased by 20% compared to the misfeeding at the second retry sheet feeding.

It is to be noted that, in the above-described case, the wear of the belt is identified as the cause of misfeeding when the actual arrival time of the current misfeeding has a correlation with the relation of the number of times of use of the belt and the actual arrival time but the actual speed of the belt, the actual number of rotations of each fan, and the actual height of the sheet loading table at the current misfeeding are substantially same as the total values or when the actual value of the number of rotations of each fan and the speed of the belt at the current misfeeding do not have a correlation with the predetermined relation obtained from the sheet feed information stored in the sheet feed information memory 68 (in other words, not deterioration of the belt motor, the lift motor, and the fans).

As described above, the causes of misfeeding are finely indicated from the sheet feed information stored in the sheet feed information memory 68. Therefore, the optimum setting according to the cause is changed to perform the retry sheet feeding. Accordingly, the success rate of the retry sheet feeding is enhanced, and therefore the jam rate is reduced.

Further, the outputs of units are increased when the cause of misfeeding is determined as deterioration of the units. However, the items to be changed other than an item related to deterioration may be changed. For example, in a case in which the misfeeding is caused by insufficient rotation due to deterioration of the upward suction fan 64, even if the drive voltage and the duty ratio are increased, failed due to in a feeding failure due to insufficient rotation due to deterioration of the upward suction fan 64, there is a case in which the number of rotations of the upward suction fan 64 is not increased sufficiently or in which the duty ratio is 100%. In this case, by increasing the output of at least one of the floating fan 62, the side floating fan 71, and the separation fan 63 or by increasing the set height of the sheet loading table 11, occurrence of misfeeding due to insufficient rotation of the upward suction fan 64 may be eliminated. As described above, misfeeding occurred due to deterioration of the drive device related to floating (i.e., the upward suction fan 64, the floating fan 62, the separation fan 63, and the lift motor) may be eliminated by increasing the output other drive devices.

In addition, in parallel with identifying the cause of deterioration of each unit, it is determined whether the cause of misfeeding relates to the sheet characteristics. When the cause of misfeeding relates to the sheet characteristics, the retry sheet feeding may be performed by integrating the modified control A and the increase in output of deteriorated unit.

At the end of sheet feeding, the correlation between the relation of the number of times of use and the actual arrival time obtained based on the sheet feed information stored in the sheet feed information memory 68 (i.e., the transition of the actual arrival time) and the actual arrival time obtained as the sheet feed information at the current sheet feeding is checked. When the correlation is confirmed, the actual number of rotations of each fan and the actual speed of the belt obtained as the sheet feed information at the current sheet feeding are checked. If there is any unit having deterioration, the output value of the unit is controlled to increase.

Further, in a case in which the lower limit value of the number of rotations of each fan and the lower limit value of the speed of the belt in the acceptable range are obtained from the sheet feed information stored in the sheet feed information memory 68, if the obtained value is the lower limit value or below, the output value of each fan and the output value of the belt motor are increased to perform he subsequent sheet feeding. There is a case in which the optimal lower limit values of the devices are different from each other depending on the operating environment and conditions of the device. Therefore, in some cases, the lower limit value obtained based on the device previously installed in test environment of a manufacturer is not an optimal lower limit value. By contrast, by obtaining the lower limit value in the acceptable range of the number of rotations of each fan and the speed of the belt from the sheet feed information stored in the sheet feed information memory 68, the optimal lower limit value of each device is controlled.

When the lower limit value in the acceptable range of the number of rotations of each fan is obtained, for example, by indicating sheet feed information by which the causes of misfeeding is determined as the insufficient number of rotations of each fan. As an example, when the actual number of rotations of each fan at misfeeding is compared with the actual number of rotations of each fan at a successful retry sheet feeding, if the number of rotations of the fan is increased, it is determined that misfeeding is caused by the insufficient number of rotations of each fan. In addition, according to the sheet feed information, based on which the insufficient number of rotations of each fan caused by deterioration of the fan is the causes of misfeeding, it is determined that the causes of misfeeding is the insufficient number of rotations of the fan.

As described above, from multiple sheet feed information in which the cause of misfeeding is determined to be the insufficient number of rotations of each fan, the lower limit values in the acceptable range are obtained by the actual number of rotations of each fan at misfeeding and the actual number of rotations of each fan at the successful retry sheet feeding. Similarly, the lower limit value of the allowable range is obtained for the speed of the belt.

Further, for example, in a case in which the first paper jam has occurred after one week from the purchase, the sheet feed information is not stored in the sheet feed information memory 68 because of the early stage of use of the device. In this case, if the causes of misfeeding cannot be specified (in particular, due to deterioration (wear) of the belt or deterioration of each of the above-described units), the retry sheet feeding may be performed under the sheet feeding conditions at occurrence of misfeeding or under the conditions of highest sheet feed efficiency. Further, the paper jam may be performed without performing the retry sheet feeding.

It is to be noted that, when the retry sheet feeding is performed under the conditions of highest sheet feed efficiency, it is difficult to specify the conditions of highest sheet feed efficiency if the sheet characteristics and the operating environment of the sheet to be fed. Therefore, in a case in which the retry sheet feeding is performed under the conditions of highest sheet feed efficiency, the whole items at the nth change in Tables 3 to 6 or the whole items at the n−1th change in Tables 3 to 6 are changed. For example, when the whole items at the nth change in Tables 3 to 6 are to be changed, the increase in output of the floating fan, the increase in output of the side floating fan, the additional lift control, the increase in output of the information suction fan, the decrease in acceleration of the suction belt, the increase in speed of the suction belt, and the extension of the arrival time are made to perform the retry sheet feeding. When the number of fed sheets exceeds the specified value and the sheet feed information is sufficiently stored in the sheet feed information memory 68, the control is switched to the retry sheet feeding control, as illustrated in FIG. 9.

Further, the cause of misfeeding according to the sheet characteristics is identified based on the sheet type information of a sheet set on the sheet loading table 11 and the causes of misfeeding according to irregular operations of the fan and the lifting drive unit 65 are identified based on information related to the sheet feeding status (e.g., the actual number of rotations of the fan and the actual height of the sheet loading table 11). Therefore, these causes of misfeeding may be identified from the start of use of the device and the modified control A or the modified control B may be performed according to the cause of misfeeding.

Next, a description is given of a sheet feeding device according to Embodiment 2 of this disclosure.

Figure 10:
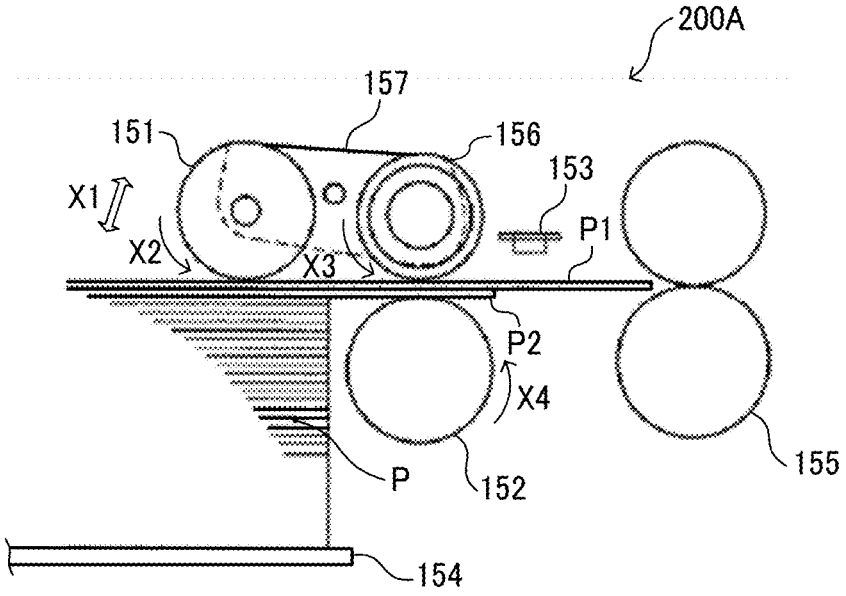
FIG. 10 is an enlarged view illustrating the main part of a sheet feeding device according to Embodiment 2 of this disclosure.

FIG. 10 is an enlarged view illustrating the main part of a sheet feeding device 200A according to Embodiment 2 of this disclosure.

As illustrated in FIG. 10, the sheet feeding device 200A according to Embodiment 2 is a sheet feeding device of a return separation type (e.g., a feed reverse roller (FRR) type), and includes an FRR mechanism 150, a pair of grip rollers 155, and a sheet feed sensor 153. The FRR mechanism 150 includes a pickup roller 151, a sheet feed roller 156, and a reverse roller 152. The pickup roller 151 contacts an uppermost sheet P1 placed on top of the sheet bundle P that is loaded on a sheet loading table 154. The sheet feed roller 156 separates the uppermost sheet P1 fed by the pickup roller 151, one by one from other sheets if fed together with the uppermost sheet P1, and feeds the uppermost sheet P1.

An arm 157 is rotatably attached to a rotary shaft of the sheet feed roller 156. The pickup roller 151 is rotatably attached to the arm 157. The arm 157 is biased by an elastic member such as a spring, in a direction in which the pickup roller 151 moves away from the sheet bundle P. According to an ON state and an OFF state of a drive unit such as a solenoid, the pickup roller 151 moves in a direction indicated by arrow X1 in FIG. 10, between a position at which the pickup roller 151 is separated from the sheet bundle P and a position at which the pickup roller 151 is in contact with the uppermost sheet P1 of the sheet bundle P. Specifically, when the drive unit is turned on (the ON state), the arm 157 is pressed in a direction opposite to the direction to bias the arm 157 by the elastic member. By so doing, the arm 157 rotates about the rotary shaft of the sheet feed roller 156 in a counterclockwise direction in FIG. 10, and therefore the pickup roller 151 contacts the uppermost sheet P1 on the sheet bundle P. When the drive unit is turned off (the OFF state), the arm 157 rotates about the rotary shaft of the sheet feed roller 156 in a clockwise direction in FIG. 10 by the biasing force of the elastic member, so that the pickup roller 151 moves to the position at which the pickup roller 151 moves away from the uppermost sheet P1 of the sheet bundle P.

The reverse roller 152 is mounted on a support shaft to be rotatable in opposite directions, in other words, forward and reverse directions, via a torque limiter. According to a driving force transmitted by a motor to the reverse roller 152 via the torque limiter, the reverse roller 152 rotates in a direction indicated by arrow X4 in FIG. 10.

A sheet feed sensor 153 is disposed between the sheet feed roller 156 and the pair of grip rollers 155.

When feeding the uppermost sheet P1 placed on top of the sheet bundle P, the pickup roller 151 is brought into contact with the uppermost sheet P1 of the sheet bundle P. Then, the pickup roller 151 is rotated in a direction indicated by arrow X2 in FIG. 10, and the sheet feed roller 156 is rotated in a direction indicated by arrow X3 in FIG. 10. By rotating the pickup roller 151 in the direction X2 in FIG. 10, some upper sheets of the sheet bundle P are fed by the frictional force to a contact portion of the sheet feed roller 156 and the reverse roller 152.

In a case in which the uppermost sheet P1 alone enters the contact portion of the sheet feed roller 156 and the reverse roller 152, the torque to be transmitted to the reverse roller 152 is relatively large, and the transmission of the driving force to the reverse roller 152 is canceled by the action of the torque limiter. Consequently, the reverse roller 152 is rotated along rotation of the sheet feed roller 156 to feed the uppermost sheet P1 together with the sheet feed roller 156.

By contrast, in a case in which multiple sheets including the uppermost sheet P1 enter the contact portion of the sheet feed roller 156 and the reverse roller 152, the torque to be transmitted to the reverse roller 152 is relatively small, and the driving force is transmitted to the reverse roller 152 via the torque limiter. Consequently, the reverse roller 152 is rotated in the direction X4 in FIG. 10. As a result, the second sheet P2 to the subsequent sheet Pn that contact the reverse roller 152 are fed in a direction to return these sheets P2 to Pn to the sheet loading table 154. Accordingly, the second sheet P2 to the subsequent sheet Pn fed together with the uppermost sheet P1 are separated from the uppermost sheet P1, and the uppermost sheet P1 alone is fed.

Similar to Embodiment 1, in Embodiment 2, in a case in which the leading end of a sheet does not pass the sheet feed sensor 153 in a time range from the start of sheet feeding to the preset arrival time, it is determined that misfeeding has occurred, and the sheet feeding is stopped. When the retry sheet feeding is set to be performed, the setting is changed to perform the retry sheet feeding. When the retry sheet feeding is not set to be performed, the jam handling is performed.

Similar to Embodiment 1, in Embodiment 2, the sheet feed roller 156 and the pickup roller 151 are provided with respective rotation amount detecting devices that includes an encoder to detect the number of rotations of the sheet feed roller 156 or the pickup roller 151, and an optical sensor. Each of the rotation amount detecting device measures the acceleration and speed of the sheet feed roller 156 or the pickup roller 151.

Further, the sheet feeding device 200A in Embodiment 2 includes a sheet feed information memory to store sheet feed information. Each time the sheet feeding is performed, sheet information including the sheet feeding conditions (e.g., sheet information, user setting information, etc.), information related to the sheet feeding state (e.g., information regarding success and failure, i.e., misfeeding, the actual acceleration of each roller, the actual speed of each roller, the actual arrival time from the start of sheet feeding to the arrival of the sheet to sheet feed sensor 153, the actual height of sheet loading table 154, the number of times of use, i.e., the number of times of sheet feedings, etc.), and sheet feed setting information (the drive voltage of a sheet feed motor to drive each roller, the drive voltage of a solenoid to lift and lower the pickup roller 151, the preset arrival time, etc.) are stored in sheet feed information memory.

In Embodiment 2, the setting of the sheet feeding is changed based on the sheet feed information stored in the sheet feed information memory to perform the retry sheet feeding.

Figure 11:
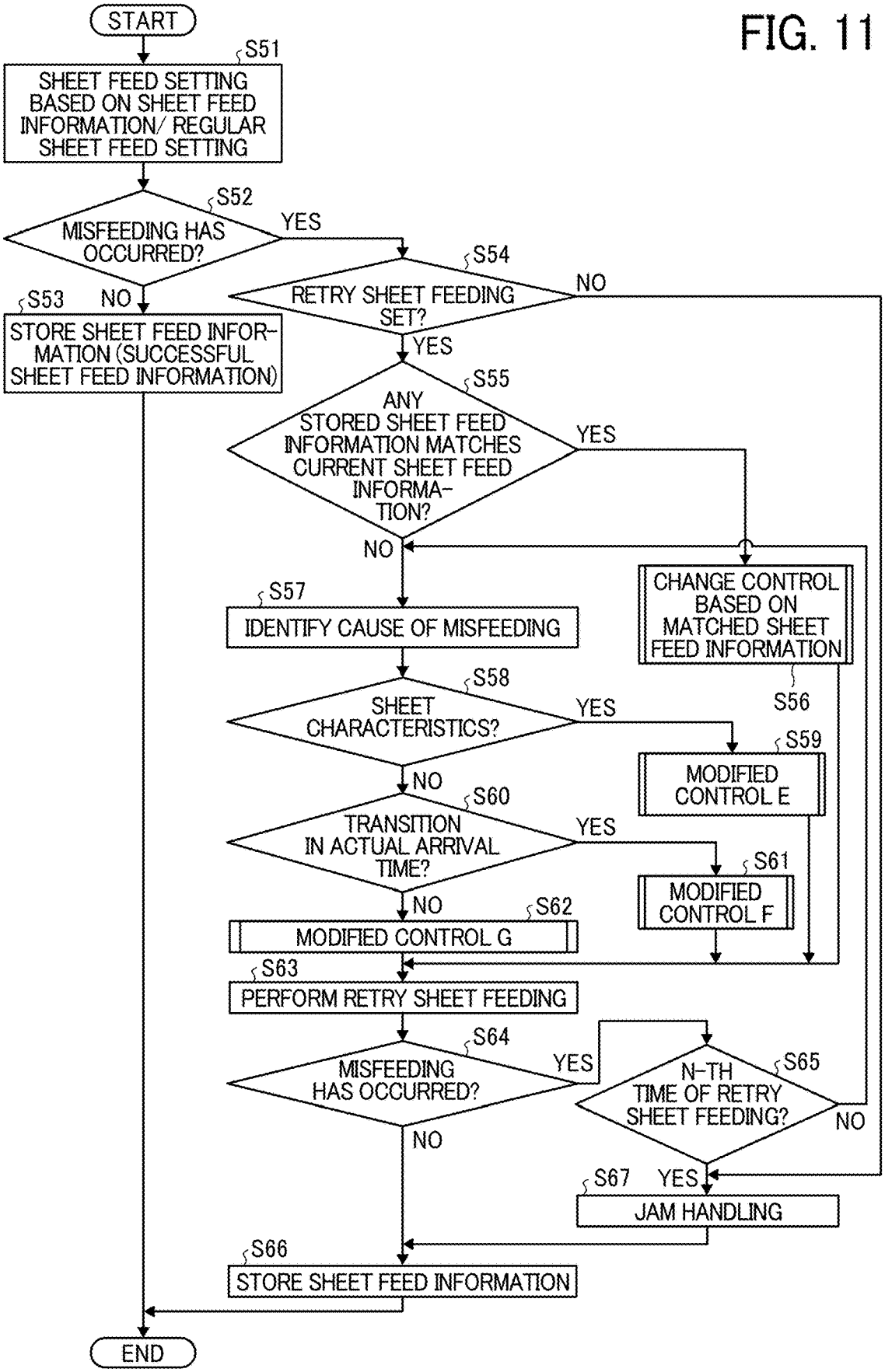
FIG. 11 is a flowchart illustrating an example of sheet feed control performed in the sheet feeding device according to Embodiment 2.

FIG. 11 is a flowchart illustrating an example of sheet feed control performed in the sheet feeding device 200A according to Embodiment 2.

In the sheet feeding device 200A according to Embodiment 2, in a case in which sheet feeding conditions that are the same as the sheet feeding conditions of the current sheet feeding are found in the sheet feed information stored in the sheet feed information memory, the setting of the sheet feeding is made based on the sheet feed setting information of the sheet feed information. By contrast, in a case in which the sheet feeding conditions of the current sheet feeding are different from the sheet feed information in the sheet feed information memory, the sheet feeding is performed with a regular sheet feed setting (step S51).

Then, it is determined whether misfeeding has occurred (step S52). When misfeeding has not occurred, in other words, the sheet feeding is performed successfully (NO in step S52), the sheet feed information of the sheet feeding is stored in the sheet feed information memory. By contrast, when the leading end of the sheet has not reached the sheet feed sensor 153 by the preset arrival time, in other words, misfeeding has occurred (YES in step S52), it is determined whether the retry sheet feeding is set (step S54). When the retry sheet feeding is set (YES in step S54), it is determined whether there is any sheet feed information that matches the sheet feed information of the current sheet feeding (step S55). When there is sheet feed information that matches the sheet feed information of the current sheet feeding (YES in step S55), the setting of the current sheet feeding is changed based on the setting change information of the matched sheet feed information (step S56) and the retry sheet feeding is performed (step S63).

By contrast, when no sheet feed information matches the sheet feed information of the current sheet feeding (NO in step S55), the causes of misfeeding is identified based on the stored sheet feed information and the sheet feed information of the current (failed) sheet feeding.

Specifically, it is determined whether the sheet characteristics has caused misfeeding (step S58). When the tendency of the arrival time deviation is observed for each sheet type, from the sheet feed information stored in the sheet feed information memory 68, in a case in which the sheet is changed for the current sheet feeding, it is determined that the current (failed) sheet feeding is caused by misfeeding due to the sheet characteristics (YES in step S58). When the sheet is not changed for the current sheet feeding, in other words, when the sheet characteristics is not the cause of misfeeding (NO in step S58), a transition of the actual arrival time of the sheet is checked from the sheet feed information stored in the sheet feed information memory (step S60). When the relation of the number of times of use of the roller in the sheet feed information stored in the sheet feed information memory and the actual arrival time has a predetermined relation (for example, a proportional relation), it is determined that the current (failed) sheet feeding is caused by deterioration (wear) of the roller (YES in step S60).

In addition, when the sheet is not changed (NO in step S58) and the actual arrival time cannot be measured or the transition of the actual arrival time of the current (failed) sheet feeding (NO in step S60), it is determined that the current (failed) sheet feeding is caused by other unexpected cause or causes.

When it is determined that the sheet characteristics are the cause of misfeeding (YES in step S58), a modified control E indicated in Table 7 is performed (step S59). When it is determined that deterioration (wear) of the roller is the cause of misfeeding (YES in step S60), a modified control F indicated in Table 8 is performed (step S61). When it is determined that other unexpected cause is the cause of misfeeding (NO in step S58 and NO in step S60), a modified control G indicated in Table 9 is performed (step S62).

TABLE 7

| | | E | | | | | | |
|---|---|---|---|---|---|---|---|---|
| | | 1st time | 2nd time | 3rd time | . . . | n-1th time | nth time | Paper Jam Handling |
| Increase of Number of Times of Retry | | GOOD | GOOD | GOOD | . . . | GOOD | GOOD | — |
| Roller | Decrease of Acceleration | GOOD | — | — | . . . | GOOD | GOOD | — |
| | Increase of Speed | — | GOOD | — | . . . | GOOD | GOOD | — |
| Lifting Device | Additional Control in Lifting and Lowering Sheet Loading Table | — | — | GOOD | . . . | — | GOOD | — |
| Sensor | Extension of Time of Arrival | — | — | — | . . . | GOOD | GOOD | — |
| Promotion to Replacement of Parts | | — | — | — | . . . | — | — | GOOD |

TABLE 8

| | | F | | | | | | |
|---|---|---|---|---|---|---|---|---|
| | | 1st time | 2nd time | 3rd time | . . . | n-1th time | nth time | Paper Jam Handling |
| Increase of Number of Times of Retry | | GOOD | GOOD | GOOD | . . . | GOOD | GOOD | — |
| Roller | Decrease of Acceleration | GOOD | — | — | . . . | GOOD | GOOD | — |
| | Increase of Speed | — | GOOD | — | . . . | GOOD | GOOD | — |
| Lifting Device | Additional Control in Lifting and Lowering Sheet Loading Table | — | — | GOOD | . . . | — | GOOD | — |
| Sensor | Extension of Time of Arrival | — | — | — | . . . | GOOD | GOOD | — |
| Check of Sheet Setting | | — | — | — | . . . | — | GOOD | GOOD |

TABLE 9

| | | G | | | | | |
|---|---|---|---|---|---|---|---|
| | | 1st time | 2nd time | 3rd time | . . . | nth time | Paper Jam Handling |
| Increase of Number of Times of Retry Sheet Feeding | | GOOD | GOOD | GOOD | . . . | GOOD | — |
| Roller | Increase of Acceleration | — | GOOD | — | . . . | — | — |
| | Increase of Speed | — | — | — | . . . | GOOD | — |
| | Decrease of Speed | — | — | GOOD | | — | — |
| | Decrease of Acceleration | — | — | — | | GOOD | — |
| Sensor | Extension of Time of Arrival | GOOD | — | — | . . . | GOOD | — |
| Promotion to Repair of Device | | — | — | — | . . . | — | GOOD |

Due to wear of the roller, the slip rate of the roller and the sheet increases. Therefore, it is considered that the leading end of the sheet did not reach the sheet feed sensor 153 by the preset arrival time. Accordingly, as indicated in Table 7, the decrease in acceleration of the roller (the pickup roller), the increase in speed of the roller, the extension of the preset arrival time, and the height of the sheet loading table are changed as the items to be changed for the modified control E to be performed when wear of the roller is the cause of misfeeding. By decreasing the acceleration of the roller, slippage between the sheet and he pickup roller is restrained, and therefore the sheet feeding performance is enhanced. Accordingly, the leading end of the sheet reaches the sheet feed sensor 17 by the preset arrival time.

In addition, by increasing the speed of the roller, even if the sheet slips against the roller, the leading end of the sheet can reach the sheet feed sensor 17 by the preset arrival time, and therefore occurrence of misfeeding is eliminated. Further, by extending the preset arrival time, even if the sheet slips against the roller, the leading end of the sheet can reach the sheet feed sensor 17 by the preset arrival time, and therefore occurrence of misfeeding is eliminated. Further, by lifting the sheet loading table 154, the contact pressure between the pickup roller and the sheet can be increased, and therefore the slip between the sheet and the pickup roller can be restrained. Consequently, the sheet feeding performance is enhanced, and the leading end of the sheet reaches the sheet feed sensor 17 by the preset arrival time.

In a case in which the sheet characteristics are the cause of misfeeding, it is considered that the main factor to cause misfeeding is a specific sheet having the characteristic to be easy to slip with respect to the roller, for example, a glossy paper. Therefore, as indicated in Table 8, the same items as in the modified control E are changed for the modified control F to be performed when the sheet characteristics are the causes of misfeeding. In this example, the items to be changed for the modified control F are the same items as for the modified control E. However, the items to be changed for the modified control E and the items to be changed for the modified control F may be different from each other, accordingly. Further, the order of the items to be changed for the modified control F may be different from the modified control E.

Further, as indicated in Table 9, the whole items related to the sheet feeding are changed for the modified control G to be performed when the cause of misfeeding is the other unexpected cause.

Similar to Embodiment 1, for the modified controls E to G in Embodiment 2, in the retry sheet feeding performed in the initial multiple times, one setting of the multiple modification items is changed to perform the retry sheet feeding (step S63). After one of the items are changed among the multiple items to be changed, the retry sheet feeding is performed, in step S63. Then, it is determined whether misfeeding has occurred (step S64). When misfeeding has occurred (YES in step S64), it is determined whether the retry sheet feeding is performed (step S65). When the retry sheet feeding is not performed (NO in step S65) and misfeeding continues to occur, two items among the multiple items to be changed are changed and then the retry sheet feeding is performed.

In a case in which misfeeding continues to occur even if the whole patterns of sets of two items of multiple settings to be changed, the number of setting change items is increased by one and the retry sheet feeding is performed. Thus, the setting change items are increased until the whole setting change items are finally changed, the retry sheet feeding is performed (the nth retry sheet feeding). When misfeeding is not eliminated even if the whole setting change items are changed and the retry sheet feeding is performed (YES in step S65), the jam handling is performed and a predetermined information message is displayed on the control unit of the image forming apparatus (step S67). Then, the sheet feed information is stored in the sheet feed information memory as reference failed sheet feed information (step S66).

As indicated in Table 7, in the modified control E, when occurrence of misfeeding is not eliminated even after the nth retry sheet feeding, it is determined the roller has reached the end of the service life. Consequently, an information message is displayed to make a user replace the roller to a new roller, on the control unit 124 of the image forming apparatus, at the jam handling As indicated in Table 8, in the modified control F, when occurrence of misfeeding is not eliminated even after the nth retry sheet feeding, it is determined that misfeeding occurs due to enter of any foreign materials by chance or improper sheet setting. Consequently, an information message is displayed to make a user check enter of any foreign materials by chance or improper sheet setting, on the control unit 124 at the jam handling.

Further, in the change control F, when occurrence of misfeeding is not eliminated even after the nth retry sheet feeding, an information message is displayed to make a user repair the sheet feeding device.

When the setting change items are changed and the retry sheet feeding is performed (step S63) and the sheet is successfully fed, in other words, misfeeding has not occurred (NO in step S64), the setting change information is associated with the failed sheet feed information of the current sheet feeding and is stored in the failed sheet feed information and the sheet feed information on the retry sheet feeding is stored as successful sheet feed information in the sheet feed information memory (step S66).

In Embodiment 2, when misfeeding has occurred, the sheet is fed to a certain extent. Therefore, in the retry sheet feeding, the setting of the successful sheet feeding may not be an optimum sheet feed setting according to the cause. Therefore, when the subsequent sheet feeding is performed with the successful sheet feed setting and misfeeding has occurred similar to the previous sheet feeding, the number of times of retry sheet feedings is read. Then, the setting change items are changed not according to the first setting change in Table 7 but according to the subsequent one from the previous setting change (for example, when the previous sheet feeding has been successful with the second setting change, the third setting change is made). Consequently, the optimum sheet feed setting is found.

In Embodiment 2, it may be determined whether deterioration of the sheet motor is the causes of misfeeding, based on the sheet feed information stored in the sheet feed information memory. It is determined that the decrease in rotational speed of the roller due to deterioration of the sheet feed motor that drives the roller is the causes of misfeeding when a transition of the actual arrival time of the current sheet feeding is observed (in other words, a predetermined correlation between the relation of the number of times of use of the roller and the actual arrival time of the current sheet feeding and the relation of the number of times of use of the roller and the actual arrival time obtained from the sheet feed information stored in the sheet feed information memory is recognized) and when the actual speed of the roller of the current misfeeding has a correlation with the relation of the number of times of use of the roller and the actual speed of the roller.

By contrast, it is determined that wear of the sheet feed roller is the cause of misfeeding when no correlation is recognized between the actual speed of the roller of the current misfeeding and the relation of the number of times of use of the roller and the actual speed of the roller.

When it is determined that deterioration of the sheet feed roller is the cause of misfeeding, the output of the sheet feed motor is increased to perform the retry sheet feeding.

Alternatively, the acceleration of rotation of the sheet feed roller is decreased to enhance the sheet feeding reliability.

It is difficult to identify deterioration of the sheet feed motor and deterioration (wear) of the sheet feed roller before a certain amount of sheet feed information is stored and accumulated. Therefore, even in Embodiment 2, the processes in the flowchart of FIG. 11 may not be performed until the certain amount of sheet feed information is stored and accumulated. In other words, the retry sheet feeding may be performed with the sheet feeding conditions used when misfeeding has occurred, the retry sheet feeding may be performed with the conditions having the highest sheet feeding efficiency, or the jam handling may be performed without performing the retry sheet feeding.

Further, the sheet feed information memory 68 may be a server connected to the sheet feeding device via the Internet communication network that is an information communication network. A state in which multiple sheet feeding devices are physically connected using a cable or cables so that the multiple sheet feeding devices can exchange information is included as one type of the information communication network.

Figure 12:
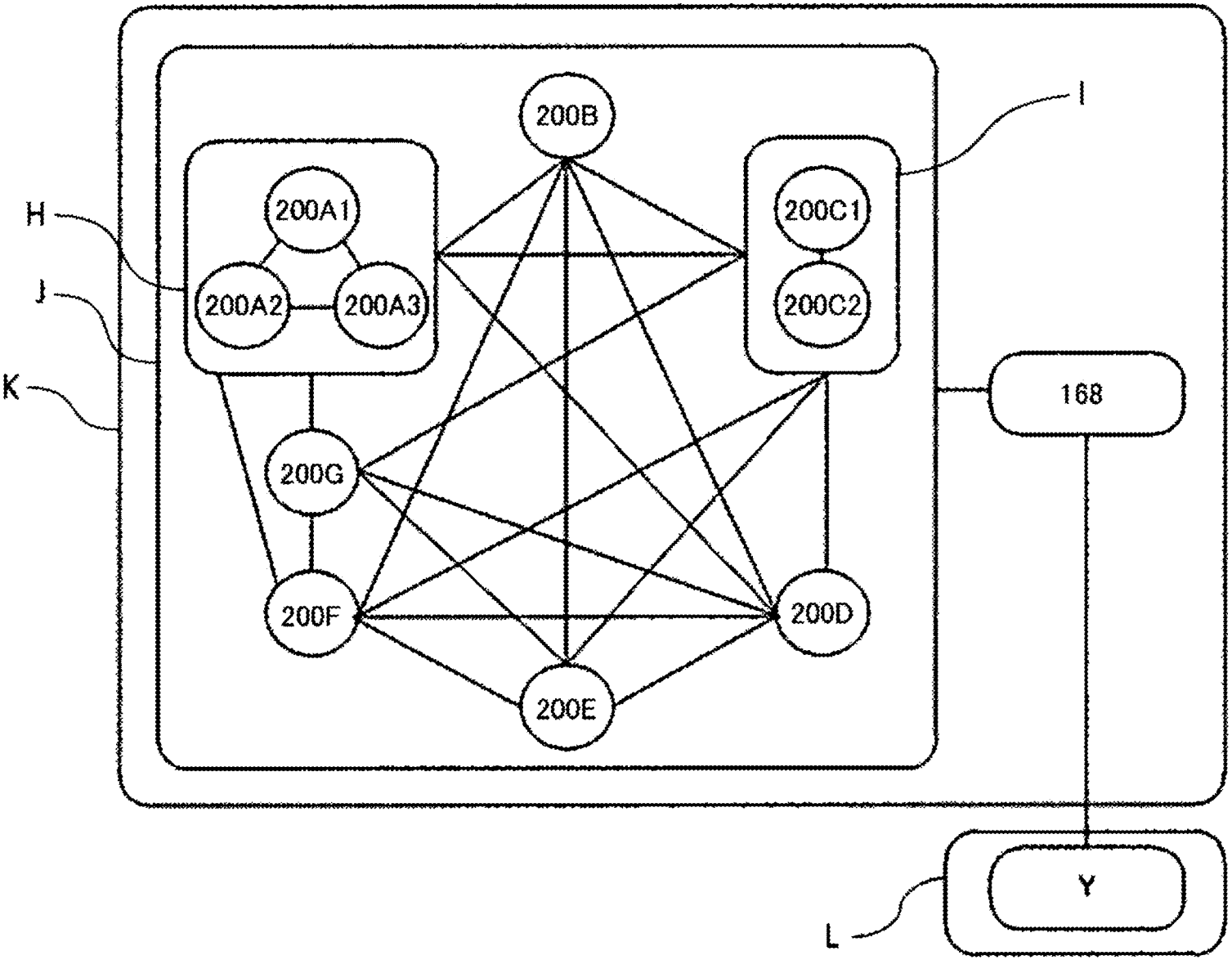
FIG. 12 is a diagram illustrating an example of an external server connected to multiple external sheet feeding devices via the Internet communication network that is an information communication network.

FIG. 12 is a diagram illustrating an example of a server 168 (or an administrator 168) connected to multiple external sheet feeding devices via the Internet communication network that is an information communication network.

Group J in FIG. 12 is a group of sheet feeding devices in which the server 168 that functions as an external memory stores and manages sheet feed information via the interne communication network that is information communication network. Group J includes sheet feeding devices 200A1, 200A2, 200A3, 200B, 200C1, 200C2, 200D, 200E, 200F, and 200G. The sheet feeding devices 200A1, 200A2, 200A3, 200B, 200C1, 200C2, 200D, 200E, 200F, and 200G are identical and compatible sheet feeding devices connected to the Internet communication network. The sheet feeding devices 200A1, 200A2, and 200A3 included in Group H and the sheet feeding devices 200C1 and 200C2 included in Group I share the same administrator and the same installation position and have the operation environments and the states similar to each other. An area K in FIG. 12 indicates specific countries and regions. An area L includes device groups such as Group H and Group J, which are similar to the server 168, and a server Y (or an administrator Y) that manages the device groups. In particular, the server Y shares and exchanges information with the server 168.

Sheet feed information of the sheet feeding devices 200A1, 200A2, 200A3, 200B, 200C1, 200C2, 200D, 200E, 200F, and 200G are transmitted to the server 168 via the Internet communication network and are accumulated (stored) in a memory such as a hard disc drive (HDD). The sheet feed information of each sheet feeding device to be transmitted to the server 168 includes, for example, information that can identify a user, such as administrative information and customer question information.

For example, in the system configuration illustrated in FIG. 12, when misfeeding occurs in the sheet feeding device 200A1, the sheet feeding device 200A1 makes access to the server 168 via the Internet communication network. Then, it is checked whether there is any sheet feed information that matches the sheet feed information of the current sheet feeding from not only the failed sheet feed information of the sheet feeding device 200A1 stored in the server 168 but also the failed sheet feed information of the other sheet feeding devices. Since a large amount of sheet feed information transmitted from the multiple sheet feeding evices can be referred to, the possibility to find the sheet feed information that matches the current sheet feed information increases. As a result, it is more likely that the setting is changed to an optimal sheet feed setting to eliminate the current misfeeding and perform the retry sheet feeding with the modified setting. Accordingly, the success rate of the retry sheet feeding is increased, resulting in a decrease in the paper jam rate.

Further, when there is no match with the sheet feed information and therefore the cause of misfeeding is identified from the sheet feed information stored in the sheet feed information memory and the current sheet feed information, the sheet feed information of multiple sheet feeding devices are be referred to so as to identify the cause of misfeeding. Accordingly, the cause of misfeeding is identified with accuracy. Further, the cause of misfeeding is identified even at the early stage of use of the sheet feeding device.

However, the operating environments of the multiple sheet feeding devices do not share the identical conditions to each other. Therefore, when compared with a configuration in which the sheet feed information stored in the sheet feed information memory is related to the sheet feeding device alone, it is likely that the accuracy of identification of the cause of misfeeding and the success rate of the retry sheet feeding with the modified sheet feed setting information stored in associate with the failed sheet feed information that matches the current sheet feed information decrease. Therefore, it may be settable by a user whether to use the sheet feed information of the multiple sheet feeding devices stored in the server 168 or the accumulated sheet feed information related to this sheet feeding device alone stored in the memory of the sheet feeding device.

Further, sheet feed information to be stored and accumulated in the server 168 may include operating environment information such as humidity and temperature. The sheet feed information stired in the server 168 may be downloaded to a SD (secure digital) card or an external HDD (hard disc drive). When using an SD card, the SD card may be inserted into a card socket in the sheet feeding device. When using an external HDD, the external HDD may be connected to another externa HDD via a USB (universal serial bus) port in the sheet feeding device. By contrast, the sheet feed information stored in an individual sheet feeding device or an image forming apparatus is stored in the SD card or the external HDD to transfer the sheet feed information to another device or the server.

The configurations according to the above-descried embodiments are not limited thereto. This disclosure can achieve the following aspects effectively.

Aspect 1.

A sheet feeding device (for example, the sheet feeding device 200) includes a sheet loader (for example, the sheet loading table 11), a sheet feeder (for example, the suction belt 21), a misfeeding detector (for example, the sheet feed sensor 17 and the sheet feeding device controller 66), a memory (for example, the sheet feed information memory 68), and circuitry (for example, the sheet feeding device controller 66). The sheet loader is configured to load a sheet of a sheet bundle (for example, the sheet bundle P). The sheet feeder is configured to feed a sheet from the sheet bundle loaded on the sheet loader. The misfeeding detector is configured to detect a misfeeding of the sheet. The memory is configured to store sheet feed information on sheet feeding. The circuitry is configured to change a sheet feed setting based on the sheet feed information stored in the memory and perform a retry sheet feeding at a detection of the misfeeding by the misfeeding detector.

By storing and accumulating the sheet feed information used for performing the sheet feeding in the memory, a cause of the misfeeding is estimated based on the sheet feed information stored in the memory to identify an optimal sheet feed setting corresponding to the cause of the misfeeding or to identify an optimal sheet feed setting from the sheet feed information stored in the memory, to eliminate the misfeeding. Therefore, by changing the sheet feed setting of the retry sheet feeding based on the sheet feed information stored in the memory, the sheet feed setting is changed to an optimal sheet feed setting. According to this change of the sheet feed setting, occurrence of misfeeding during the retry sheet feeding is restrained. Accordingly, when compared with a known sheet feeding device, the jam rate of the sheet feeding device according to this disclosure is reduced.

Aspect 2.

In Aspect 1, the sheet feed information stored in the memory (for example, the sheet feed information memory 68) includes misfeed information on the misfeeding and a successful sheet feed setting resulted in a successful retry sheet feeding, with the misfeed information being associated with the successful sheet feed setting. In a case in which current sheet feed information resulted in the misfeeding prior to the retry sheet feeding matches the misfeed information stored in the memory, the circuitry (for example, the sheet feeding device controller 66) is configured to change the sheet feed setting to the successful sheet feed setting stored in association with the misfeed information in the memory, and perform the retry sheet feeding.

According to this operation, as described in the flowchart of FIG. 9 (see step S15 (YES) and step S16), the sheet feed setting is changed based on the cause of the current misfeeding. Therefore, the success rate of the retry sheet feeding is increased, and the jam rate of the sheet feeding device is reduced. Further, an optimal sheet feed setting is found quickly.

Aspect 3.

In Aspect 1 or Aspect 2, the circuitry (for example, the sheet feeding device controller 66) is configured to estimate a cause of the misfeeding based on the sheet feed information stored in the memory (for example, the sheet feed information memory 68) and the sheet feed information that has resulted in the misfeeding prior to the retry sheet feeding, change the sheet feed setting based on the cause of the misfeeding, and perform the retry sheet feeding.

According to this operation, as described in the flowchart of FIG. 9 (see steps S17 to S27), the sheet feed setting is changed based on the cause of the misfeeding to perform the retry sheet feeding. Accordingly, the success rate of the retry sheet feeding is increased, and the jam rate of the sheet feeding device is reduced.

Aspect 4.

In Aspect 3, the circuitry (for example, the sheet feeding device controller 66) is configured to determine a transition of a sheet feeding state (for example, the arrival time) in a predetermined time from the sheet feed information stored in the memory (for example, the sheet feed information memory 68), and estimate the cause of the misfeeding based on a correlation between the transition of the sheet feeding state and the misfeeding prior to the retry sheet feeding.

According to this operation, as described in the embodiments above, the misfeeding caused by deterioration of parts or units (for example, wear of the belt, deterioration of the belt motor, each fan, and the lift motor) used for sheet feeding is determined, and therefore the sheet feed setting is changed based on the cause of deterioration of the part or unit to perform the retry sheet feeding. Accordingly, the success rate of the retry sheet feeding is increased, and the jam rate of the sheet feeding device is reduced.

Aspect 5.

In Aspect 4, the sheet feeding device (for example, the sheet feeding device 200) further includes an air blower (for example, the floating fan 62 and the side floating fan 71), a separator (for example, the separation fan 63), and an air suction unit (for example, the upward suction fan 64). The air blower is configured to blow air toward a sheet bundle (for example, the sheet bundle P) loaded on the sheet loader (for example, the sheet loading table 11) to float multiple sheets (for example, the uppermost sheet P1, the second sheet P2) on an upper portion of the sheet bundle. The separator is configured to blow air toward a portion between an uppermost sheet (for example, the uppermost sheet P1) and a subsequent sheet (for example, the second sheet P2) of the multiple sheets floated by the air blower, to separate the uppermost sheet and the subsequent sheet. The air suction unit is configured to suck air to move the uppermost sheet floated by the air blower to the sheet feeder (for example, the suction belt 21). The sheet feed information includes an arrival time of the sheet from when the sheet feeding is started, to when the sheet reaches a position located downstream from the sheet feeder in the sheet feeding direction. The circuitry (for example, the sheet feeding device controller 66) is configured to determine the transition of the arrival time in the predetermined time as the transition of the sheet feeding state, increase an output at least one of the air blower, the separator, and the air suction unit in a case in which there is a correlation between the transition of the arrival time and an arrival time in the misfeeding prior to the retry sheet feeding, and perform the retry sheet feeding.

According to this configuration, as described in the embodiments above, the number of rotations of the air blower, the separator, and the air suction unit is gradually decreased due to deterioration of the air blower, the separator, and the air suction unit, and therefore the arrival time of the sheet is gradually delayed. Therefore, the deterioration of the air blower, the separator, and the air suction unit is determined from the transition of the arrival time in the predetermined time as the sheet feeding state. Consequently, the sheet feed setting is changed to eliminate the misfeeding caused by deterioration of the air blower, the separator, and the air suction unit, to perform the retry sheet feeding. Accordingly, the success rate of the retry sheet feeding is increased, and the jam rate of the sheet feeding device is reduced.

Aspect 6.

In Aspect 4, the sheet feed information includes an arrival time of the sheet from when the sheet feeding is started, to when the sheet reaches a position located downstream from the sheet feeder (for example, the suction belt 21) in the sheet feeding direction. The circuitry (for example, the sheet feeding device controller 66) is configured to determine a transition of the arrival time in the predetermined time as the transition of the sheet feeding state, change at least one of a sheet feeding speed of the sheet feeder and an acceleration of the sheet feeder in a case in which there is a correlation between the transition of the arrival time and an arrival time in the misfeeding prior to the retry sheet feeding, and perform the retry sheet feeding.

According to this configuration, as described in the embodiments above, the number of rotations of the drive source (for example, the belt motor) to drive the sheet feeder is reduced due to deterioration of the drive source, and therefore the acceleration and the speed of the sheet feeder are gradually decreased. Therefore, the arrival time in the predetermined time is gradually extended. When there is a correlation between the transition of the arrival time in the predetermined period and the arrival time at the misfeeding prior to the retry sheet feeding, it is estimated that the misfeeding is caused by the deterioration of the drive source. Consequently, by changing at least one of the sheet conveying speed of the sheet feeder and the acceleration of the sheet feeder, the misfeeding caused by deterioration of the drive source is eliminated. Accordingly, the success rate of the retry sheet feeding is increased, and the jam rate of the sheet feeding device is reduced.

Aspect 7.

In Aspect 4, the sheet feeding device (for example, the sheet feeding device 200) further includes a loader elevator (for example, the lifting drive unit 65) configured to elevate the sheet loader (for example, the sheet loading table 11). The sheet feed information includes an arrival time of the sheet from when the sheet feeding is started, to when the sheet reaches a position located downstream from the sheet feeder (for example, the suction belt 21) in the sheet feeding direction. The circuitry (for example, the sheet feeding device controller 66) is configured to determine a transition of the arrival time in the predetermined time as the transition of the sheet feeding state, elevate the sheet loader in a case in which there is a correlation between the transition of the arrival time and an arrival time in the misfeeding prior to the retry sheet feeding, and perform the retry sheet feeding.

According to this configuration, as described in the embodiments above, the number of rotations of the drive source (for example, the drive motor of the lifting drive unit 65) that elevates the sheet loader is deteriorated. Therefore, the position of the sheet loader relative to the predetermined height of the sheet loader is gradually lowered. As a result, the arrival time is gradually delayed (extended). Therefore, if there is a correlation between the transition of the arrival time and the arrival time at the misfeeding prior to the retry sheet feeding, it is estimated that the misfeeding is caused by deterioration of the lifting device (for example, the lifting drive unit 65). Consequently, if there is the correlation between the transition of the arrival time and the arrival time at the misfeeding prior to the retry sheet feeding, the sheet loader is elevated to eliminate the cause of the misfeeding caused by the deterioration of the lifting device. Accordingly, the success rate of the retry sheet feeding is increased, and the jam rate of the sheet feeding device is reduced.

Aspect 8.

In any one of Aspects 1 to 7, the misfeeding detector (for example, the sheet feed sensor 17 and the sheet feeding device controller 66) includes a sheet sensor (for example, the sheet feed sensor 17) disposed downstream from the sheet feeder (for example, the suction belt 21) in a sheet feeding direction and configured to detect the sheet fed by the sheet feeder. The sheet feed information includes actual arrival time information of the sheet from when the sheet feeding is started, to when the sheet sensor detects the sheet.

According to this configuration, as described in the embodiments above, the transition of the arrival time from the sheet feed information stored in the memory (for example, the sheet feed information memory 68) is determined to estimate misfeeding caused by deterioration in parts or units related to sheet feeding.

Aspect 9.

In any one of Aspects 1 to 8, the sheet feed information includes sheet information of a sheet to be fed.

According to this configuration, as described in the embodiments above, as described in the embodiment, change of the feeding state and change of the sheet are detected from the sheet feed information stored in the memory (for example, the sheet feed information memory 68). Accordingly, it is determined whether the misfeeding is caused by the sheet characteristics.

Aspect 10.

In any one of Aspects 1 to 9, the sheet feed information includes the sheet feed setting in the sheet feeding.

According to this configuration, as described in step S11 in the flowchart of FIG. 9, the optimal sheet feed setting is identified from the sheet feed information stored in the memory (for example, the sheet feed information memory 68) when performing the sheet feeding, and therefore the sheet feeding is performed with the optimal sheet feed setting based on the sheet feed information stored in the memory. Accordingly, occurrence of misfeeding is restrained.

Aspect 11.

In any one of Aspects 1 to 10, the sheet feeding device (for example, the sheet feeding device 200) further includes a drive state detector (for example, the rotation amount detecting device 2) configured to detect a drive state of the sheet feeder (for example, the suction belt 21). The sheet feed information includes the drive state (for example, the belt speed and the belt acceleration) of the sheet feeder detected by the drive state detector.

According to this configuration, as described in the embodiments above, the transition of the drive state (for example, the actual belt speed and the actual belt acceleration) of the sheet feeder detected by the drive state detector is determined from the sheet feed information stored and accumulated in the memory (for example, the sheet feed information memory 68). Therefore, a state of deterioration of a drive source (for example, the belt motor 61) configured to drive the sheet feeder is determined. Accordingly, it is estimated whether the cause of the misfeeding is based on deterioration of the drive source of the sheet feeder.

Aspect 12.

In any one of Aspects 1 to 11, the circuitry (for example, the sheet feeding device controller 66) is configured to change the sheet feed setting of at least one of a sheet feeding speed of the sheet feeder (for example, the suction belt 21) and acceleration of the sheet feeder, and perform the retry sheet feeding.

According to this configuration, as described in the embodiments above, the misfeeding caused by the sheet conveyance system. Accordingly, the success rate of the retry sheet feeding, and the jam rate of the sheet feeding device is reduced.

Aspect 13.

In any one of Aspects 1 to 12, the sheet feeding device (for example, the sheet feeding device 200) further includes an air blower (for example, the floating fan 62 and the side floating fan 71), a separator (for example, the separation fan 63), and an air suction unit (for example, the upward suction fan 64). The air blower is configured to blow air toward a sheet bundle (for example, the sheet bundle P) loaded on the sheet loader to float multiple sheets (for example, the uppermost sheet P1 and the second sheet P2) on an upper portion of the sheet bundle. The separator is configured to blow air toward a portion between an uppermost sheet (for example, the uppermost sheet P1) and a subsequent sheet (for example, the second sheet P2) of the multiple sheets floated by the air blower, to separate the uppermost sheet and the subsequent sheet. The air suction unit is configured to suck air to move the uppermost sheet floated by the air blower to the sheet feeder. The circuitry (for example, the sheet feeding device controller 66) is configured to change a sheet feed setting of at least one of the air blower, the separator, and the air suction unit prior to the retry sheet feeding, and perform the retry sheet feeding.

According to this configuration, as described in the embodiments above, the misfeeding caused by the insufficient floating of the sheet is eliminated. Accordingly, the success rate of the retry sheet feeding is increased, and the jam rate of the sheet feeding device is reduced.

Aspect 14.

In any one of Aspects 1 to 13, the misfeeding detector (for example, the sheet feed sensor 17) includes a sheet sensor (for example, the sheet feed sensor 17) disposed downstream from the sheet feeder (for example, the suction belt 21) in a sheet feeding direction and configured to detect the sheet fed by the sheet feeder. The sheet feed information includes a preset arrival time at which the sheet reaches the sheet sensor. The circuitry (for example, the sheet feeding device controller 66) is configured to determined that the misfeeding has occurred in a case in which the sheet sensor does not detect the sheet from when the sheet feeding is started until the preset arrival time has passed, change the preset arrival time as the sheet feed setting, and perform the retry sheet feeding.

According to this configuration, as described in the embodiments above, the misfeeding caused by wear of the sheet conveyance system and wear of the belt is eliminated. Accordingly, the success rate of the retry sheet feeding is increased, and the jam rate of the sheet feeding device is reduced.

Aspect 15.

In any one of Aspects 1 to 14, the circuitry (for example, the sheet feeding device controller 66) is configured to change a height of the sheet loader as the sheet feed setting, and perform the retry sheet feeding.

According to this configuration, as described in the embodiments above, the misfeeding caused by insufficient floating and the sheet characteristics are eliminated. Accordingly, the success rate of the retry sheet feeding is increased, and the jam rate of the sheet feeding device is reduced.

Aspect 16.

In any one of Aspects 1 to 15, the circuitry (for example, the sheet feeding device controller 66) is configured to change the sheet feed setting until the misfeeding is eliminated, perform the retry sheet feeding for multiple times, and inform that a part related to sheet feeding has defect when the misfeeding remains even after the retry sheet feeding has been performed for the multiple times.

According to this operation, as described in the embodiments above, a repair of the device is promoted.

Aspect 17.

In any one of Aspects 1 to 16, the sheet feeding device (for example, the sheet feeding device 200A) is configured to communicate with an external memory (for example, the server 168) in which sheet feed information of another sheet feeding device is stored, via an information communication network.

According to this operation, as described in the embodiments above, the sheet feed setting is changed based on a large amount of sheet feed information including sheet feed information of different external sheet feeding devices, to perform the retry sheet feeding. Accordingly, it is highly likely that the retry sheet feeding is performed with the optimal sheet feed setting that eliminates the misfeeding. Therefore, the success rate of the retry sheet feeding is increased, and the jam rate of the sheet feeding device is reduced. In addition, even in the misfeeding at the initial stage of use of the sheet feeding device, the sheet feed setting is changed to the optimal sheet feed setting that eliminates the misfeeding, from the sheet feed information of different sheet feeding devices, stored in the external memory.

Aspect 18.

In Aspect 17, the circuitry (for example, the sheet feeding device controller 66) change the sheet feed setting based on sheet feed information of said another sheet feeding device, stored in the external memory (for example, the server 168), and perform the retry sheet feeding.

According to this operation, as described in the embodiments above, the sheet feed setting is changed based on the sheet feed information of different sheet feeding devices, stored in the external memory, to perform the retry sheet feeding. Accordingly, it is highly likely that the retry sheet feeding is performed with the optimal sheet feed setting that eliminates the misfeeding. Therefore, the success rate of the retry sheet feeding is increased, and the jam rate of the sheet feeding device is reduced. In addition, even in the misfeeding at the initial stage of use of the sheet feeding device, the sheet feed setting is changed to the optimal sheet feed setting that eliminates the misfeeding, from the sheet feed information of different sheet feeding devices, stored in the external memory.

Aspect 19.

An image forming system (for example, the image forming system 1) includes an image forming apparatus (for example, the image forming apparatus 100) configured to perform image formation, and the sheet feeding device (for example, the sheet feeding device 200) of any one of Aspects 1 to 16, configured to feed a sheet toward the image forming apparatus.

According to this operation, the jam rate is reduced preferably.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of the invention, and are included in the scope of the invention recited in the claims and its equivalent.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet feeding device, comprising:

a sheet loader configured to load a sheet of a sheet bundle;

a sheet feeder configured to feed the sheet from the sheet bundle loaded on the sheet loader;

a misfeeding detector configured to detect a misfeeding of the sheet;

a memory configured to store sheet feed information on sheet feeding, wherein the sheet feed information includes sheet information of the sheet; and circuitry configured to change a sheet feed setting based on the sheet feed information stored in the memory and perform a retry sheet feeding in response to detecting the misfeeding by the misfeeding detector.

2. The sheet feeding device according to claim 1, wherein the sheet feed information stored in the memory includes misfeed information on the misfeeding and a successful sheet feed setting that resulted in a successful retry sheet feeding, with the misfeed information being associated with the successful sheet feed setting, and wherein, when current sheet feed information that resulted in the misfeeding prior to the retry sheet feeding matches the misfed information stored in the memory, the circuitry is further configured to:

change the sheet feed setting to the successful sheet feed setting stored in association with the misfeed information in the memory; and perform the retry sheet feeding.

3. The sheet feeding device according to claim 1, wherein the circuitry is further configured to:

estimate a cause of the misfeeding based on the sheet feed information stored in the memory and the sheet feed information that has resulted in the misfeeding prior to the retry sheet feeding;

change the sheet feed setting based on the estimated cause of the misfeeding; and perform the retry sheet feeding.

4. The sheet feeding device according to claim 3, wherein the circuitry is further configured to:

determine a transition of a sheet feeding state in a predetermined time from the sheet feed information stored in the memory; and estimate the cause of the misfeeding based on a correlation between the transition of the sheet feeding state and the misfeeding prior to the retry sheet feeding.

5. The sheet feeding device according to claim 4, further comprising:

an air blower configured to blow air toward a sheet bundle loaded on the sheet loader to float multiple sheets on an upper portion of the sheet bundle;

a separator configured to blow air toward a portion between an uppermost sheet and a subsequent sheet of the multiple sheets floated by the air blower, to separate the uppermost sheet and the subsequent sheet; and an air suction device configured to suck air to move the uppermost sheet floated by the air blower to the sheet feeder, wherein the sheet feed information includes an arrival time of the sheet from when the sheet feeding is started, to when the sheet reaches a position located downstream from the sheet feeder in a sheet feeding direction, and wherein the circuitry is further configured to:

determine a transition of the arrival time in the predetermined time as the transition of the sheet feeding state;

increase an output at least one of the air blower, the separator, and the air suction device when there is a correlation between the transition of the arrival time and an arrival time in the misfeeding prior to the retry sheet feeding; and perform the retry sheet feeding.

6. The sheet feeding device according to claim 4, wherein the sheet feed information includes an arrival time of the sheet from when the sheet feeding is started, to when the sheet reaches a position located downstream from the sheet feeder in the sheet feeding direction, and wherein the circuitry is further configured to:

determine a transition of the arrival time in the predetermined time as the transition of the sheet feeding state;

change at least one of a sheet feeding speed of the sheet feeder and an acceleration of the sheet feeder when there is a correlation between the transition of the arrival time and an arrival time in the misfeeding prior to the retry sheet feeding; and perform the retry sheet feeding.

7. The sheet feeding device according to claim 4, further comprising:

a loader elevator configured to elevate the sheet loader, wherein the sheet feed information includes an arrival time of the sheet from when the sheet feeding is started, to when the sheet reaches a position located downstream from the sheet feeder in the sheet feeding direction, and wherein the circuitry is further configured to:

determine a transition of the arrival time in the predetermined time as the transition of the sheet feeding state;

elevate the sheet loader when there is a correlation between the transition of the arrival time and an arrival time in the misfeeding prior to the retry sheet feeding; and perform the retry sheet feeding.

8. The sheet feeding device according to claim 1, wherein the misfeeding detector includes a sheet sensor disposed downstream from the sheet feeder in a sheet feeding direction and configured to detect the sheet fed by the sheet feeder, and wherein the sheet feed information includes actual arrival time information of the sheet from when the sheet feeding is started, to when the sheet sensor detects the sheet.

9. The sheet feeding device according to claim 1, wherein the sheet feed information includes the sheet feed setting.

10. The sheet feeding device according to claim 1, further comprising:

a drive state detector configured to detect a drive state of the sheet feeder, wherein the sheet feed information includes the drive state of the sheet feeder detected by the drive state detector.

11. The sheet feeding device according to claim 1, wherein the circuitry is further configured to:

change the sheet feed setting of at least one of a sheet feeding speed of the sheet feeder and an acceleration of the sheet feeder; and perform the retry sheet feeding.

12. The sheet feeding device according to claim 1, further comprising:

an air blower configured to blow air toward a sheet bundle loaded on the sheet loader to float multiple sheets on an upper portion of the sheet bundle;

a separator configured to blow air toward a portion between an uppermost sheet and a subsequent sheet of the multiple sheets floated by the air blower, to separate the uppermost sheet and the subsequent sheet; and an air suction unit configured to suck air to move the uppermost sheet floated by the air blower to the sheet feeder, wherein the circuitry is further configured to:

change a sheet feed setting of at least one of the air blower, the separator, and the air suction unit prior to the retry sheet feeding; and perform the retry sheet feeding.

13. The sheet feeding device according to claim 1, wherein the misfeeding detector includes a sheet sensor disposed downstream from the sheet feeder in a sheet feeding direction and configured to detect the sheet fed by the sheet feeder, wherein the sheet feed information includes a preset arrival time at which the sheet reaches the sheet sensor, and wherein the circuitry is further configured to:

determine that the misfeeding has occurred in a case in which the sheet sensor does not detect the sheet from when the sheet feeding is started until the preset arrival time has passed;

change the preset arrival time as the sheet feed setting; and perform the retry sheet feeding.

14. The sheet feeding device according to claim 1, wherein the circuitry is further configured to:

change a height of the sheet loader as the sheet feed setting; and perform the retry sheet feeding.

15. The sheet feeding device according to claim 1, wherein the circuitry is further configured to:

change the sheet feed setting;

perform the retry sheet feeding for multiple times; and inform that a part related to sheet feeding has a defect when the misfeeding remains even after the retry sheet feeding has been performed for the multiple times.

16. The sheet feeding device according to claim 1, wherein the sheet feeding device is configured to communicate with an external memory in which other sheet feed information of another sheet feeding device is stored, via an information communication network.

17. The sheet feeding device according to claim 16, wherein the circuitry is further configured to:

change the sheet feed setting based on the other sheet feed information of said another sheet feeding device, stored in the external memory; and perform the retry sheet feeding.

18. An image forming system comprising:

an image forming apparatus configured to perform image formation; and the sheet feeding device according to claim 1, configured to feed a sheet toward the image forming apparatus.

19. A sheet feeding device, comprising:

a sheet loader configured to load a sheet of a sheet bundle;

a sheet feeder configured to feed the sheet from the sheet bundle loaded on the sheet loader;

a misfeeding detector configured to detect a misfeeding of the sheet;

a memory configured to store sheet feed information on sheet feeding; and circuitry configured to change a sheet feed setting based on the sheet feed information stored in the memory and perform a retry sheet feeding in response to detecting the misfeeding by the misfeeding detector, wherein the circuitry is further configured to:

estimate a cause of the misfeeding based on the sheet feed information stored in the memory and the sheet feed information that has resulted in the misfeeding prior to the retry sheet feeding;

change the sheet feed setting based on the estimated cause of the misfeeding; and perform the retry sheet feeding.

20. A sheet feeding device, comprising:

a sheet loader configured to load a sheet of a sheet bundle;

a sheet feeder configured to feed the sheet from the sheet bundle loaded on the sheet loader;

a misfeeding detector configured to detect a misfeeding of the sheet;

a memory configured to store sheet feed information on sheet feeding;

circuitry configured to change a sheet feed setting based on the sheet feed information stored in the memory and perform a retry sheet feeding in response to detecting the misfeeding by the misfeeding detector; and a drive state detector configured to detect a drive state of the sheet feeder, wherein the sheet feed information includes the drive state of the sheet feeder detected by the drive state detector.

* * * * *